US008141748B2

(12) United States Patent
Kim

(10) Patent No.: US 8,141,748 B2
(45) Date of Patent: Mar. 27, 2012

(54) DISPENSER RELATED TECHNOLOGY

(75) Inventor: Jun-Hee Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 539 days.

(21) Appl. No.: 12/399,159

(22) Filed: Mar. 6, 2009

(65) Prior Publication Data

US 2009/0249818 A1 Oct. 8, 2009

(30) Foreign Application Priority Data

Apr. 7, 2008 (KR) ..... 10-2008-0032350

(51) Int. Cl.
*B67D 7/12* (2010.01)

(52) U.S. Cl. ..... 222/182; 222/146.6; 62/389

(58) Field of Classification Search ..... 222/530–538, 222/146.1, 146.6, 182, 52, 63; 62/389–400, 62/66, 459, 98
See application file for complete search history.

(56) References Cited

U.S. PATENT DOCUMENTS

| | | | | |
|---|---|---|---|---|
| 2,504,622 | A * | 4/1950 | Band et al. | 222/162 |
| 3,747,363 | A * | 7/1973 | Grimm | 62/377 |
| 4,227,383 | A * | 10/1980 | Horvay | 62/344 |
| 7,316,121 | B2 | 1/2008 | Lee et al. | |
| 7,383,689 | B2 | 6/2008 | Lee et al. | |
| 7,628,032 | B2 * | 12/2009 | Lee et al. | 62/344 |
| 8,006,502 | B2 * | 8/2011 | Kim et al. | 62/66 |
| 2005/0056043 | A1 | 3/2005 | Lee et al. | |
| 2005/0268638 | A1 * | 12/2005 | Voglewede et al. | 62/389 |
| 2006/0201194 | A1 | 9/2006 | Bowen et al. | |
| 2007/0271949 | A1 | 11/2007 | Lee et al. | |
| 2008/0178626 | A1 * | 7/2008 | Jang et al. | 62/344 |
| 2008/0190132 | A1 * | 8/2008 | Voglewede et al. | 62/389 |
| 2008/0314065 | A1 * | 12/2008 | Kim | 62/389 |
| 2009/0008403 | A1 * | 1/2009 | Lee et al. | 221/89 |
| 2009/0095010 | A1 * | 4/2009 | Moon | 62/391 |
| 2010/0071401 | A1 * | 3/2010 | Jang et al. | 62/391 |
| 2010/0175417 | A1 * | 7/2010 | Kim | 62/389 |

FOREIGN PATENT DOCUMENTS

| | | | |
|---|---|---|---|
| EP | 2292992 | A1 | 3/2011 |
| KR | 20040085932 | A | 10/2004 |
| KR | 20050028360 | A | 3/2005 |
| KR | 10-2005-0010698 | A | 8/2005 |
| KR | 10-2006-0106350 | A | 10/2006 |

OTHER PUBLICATIONS

Korean Office Action issued in Korean Application No. 10-2008-0032350, dated Nov. 27, 2009, 4 pages.
Korean Office Action issued in Korean Patent Application No. 10-2008-0032361, mailed Dec. 7, 2009, 4 pages.

* cited by examiner

*Primary Examiner* — Kevin P Shaver
*Assistant Examiner* — Robert Nichols, II
(74) *Attorney, Agent, or Firm* — Fish & Richardson P.C.

(57) ABSTRACT

A refrigerator, in which a dispensing unit moves between a received position and a dispensing position and a dispensing button unit moves, in a plane perpendicular to a surface of a door, between a stored position and an extended position. The dispensing button unit is configured to, in the extended position, control dispensing of content through the dispenser outlet in response to application of force to the dispensing button unit. The refrigerator also includes a driving unit that moves the dispensing unit from the received position to the dispensing position in response to user input and moves, in the plane to perpendicular to the surface of the door and simultaneously with moving the dispensing unit, the dispensing button unit from the stored position to the extended position in response to the user input.

19 Claims, 19 Drawing Sheets

DISPENSER RELATED TECHNOLOGY

CROSS REFERENCE TO RELATED APPLICATIONS

This application claims the benefit of Korean Patent Application No. 10-2008-0032350, filed on Apr. 7, 2008, which is hereby incorporated by reference for all purposes as if fully set forth herein.

FIELD

The present disclosure relates to dispenser technology.

BACKGROUND

In general, a refrigerator is a device that preserves items, such as food or beverages, in storage in a cool or frozen state by using cool air generated by a refrigerating cycle. A refrigerator may include an ice maker configured to make ice and a dispenser configured to dispense liquid water and ice made by the ice maker.

SUMMARY

In one aspect, a refrigerator having a dispenser includes a cooling compartment and a door configured to open and close at least a portion of the cooling compartment. The refrigerator also includes a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment, and a dispensing button unit that is configured to move, in a plane perpendicular to the surface of the door, between a stored position at which the dispensing button unit is positioned on the side of the surface of the door where the cooling compartment is positioned and an extended position at which at least a portion of the dispensing button unit is positioned on the side of the surface of the door opposite of the cooling compartment. The dispensing button unit is configured to, in the extended position, control dispensing of content through the dispenser outlet in response to application of force to the dispensing button unit. The refrigerator further includes a driving unit that is configured to move the dispensing unit from the received position to the dispensing position in response to user input and that is configured to move, in the plane perpendicular to the surface of the door and simultaneously with moving the dispensing unit, the dispensing button unit from the stored position to the extended position in response to the user input.

Implementations may include one or more of the following features. For example, a hinge may connect a portion of the dispensing unit with the door, the dispensing unit may be configured to rotate, about an axis defined based on the hinge, between the received position and the dispensing position, and the driving unit may be configured to rotate the dispensing unit from the received position to the dispensing position. The dispensing unit may include a cover unit that is positioned in a plane of the surface of the door when the dispensing unit is oriented in the received position and that is configured to cover a space in the door in which the dispensing unit is received when the dispensing unit is oriented in the received position, and a guide unit that is attached to a surface of the cover unit positioned closest to the cooling compartment, that defines the dispenser outlet, and that is configured to guide ice through the dispenser outlet when the dispensing unit is oriented in the dispensing position.

In some examples, the dispensing button unit may include a button frame unit that is positioned below the dispensing unit when the refrigerator is oriented in a normal operating orientation and that is configured to move, in the plane perpendicular to the surface of the door, between the stored position at which the button frame unit is positioned on the side of the surface of the door where the cooling compartment is positioned and the extended position at which at least a portion of the button frame unit is positioned on the side of the surface of the door opposite of the cooling compartment, and a button unit that is elastically supported by the button frame unit and that is configured to, when the button frame unit is oriented in the extended position, move, in response to application of force to the button unit, toward the surface of the door from a first position to a second position that is closer to the surface of the door than the first position and move, in response to release of the force applied to the button unit, away from the surface of the door from the second position to the first position. In these examples, the button unit may include a residual ice receiving unit and is configured to receive and store, in the residual ice receiving unit, ice discharged from the dispenser outlet after a container used in actuating the button unit is moved from beneath the dispenser outlet.

Further, the refrigerator may include a button movement restricting unit that defines a maximum pressed position of the button unit and that is configured to restrict movement of the button unit toward the cooling compartment after the button unit has been pressed to the maximum pressed position. The button movement restricting unit may include a hinge portion that, when the refrigerator is oriented in a normal operating orientation, defines an axis that is perpendicular to a direction of movement of the button unit and that is located below the button unit, first and second extending portions that, when the refrigerator is oriented in the normal operating orientation, extend upward with respect to the hinge portion toward the button unit, and a third extending portion that extends at an angle from an end of the second extending portion and that is positioned to contact a surface of the button unit when the button unit has been pressed to the maximum pressed position.

The end of the first extending portion may contact a lower surface of the button frame unit at the extended position and may contact a lower surface of the button unit at the stored position. In addition, the third extending portion may be positioned below the button frame unit when the button frame unit is oriented in the stored position and the refrigerator is oriented in the normal operating orientation. When the button frame unit moves from the stored position to the extended position, the button frame unit may contact the first extending portion and thereby rotate, about the axis defined by the hinge portion, the first extending portion downward from the button frame unit, which causes the second extending portion to rotate upward toward the button frame unit.

The button unit may include a residual ice receiving unit and may be configured to receive and store, in the residual ice receiving unit, ice discharged from the dispenser outlet after a container used in actuating the button unit is moved from beneath the dispenser outlet. The button unit also may include a button body to which the residual ice receiving unit is detachably connected.

In some implementations, the driving unit may include a driving gear configured to be driven by a motor, a first following gear engaged with the driving gear and configured to rotate the dispensing unit from the received position to the dispensing position in response to the driving gear being driven by the motor, and a second following gear engaged with the driving gear and configured to move the dispensing button unit from the stored position to the extended position in response to the driving gear being driven by the motor. In these implementations, the driving gear, the first following gear, and the second following gear may be configured to rotate in a plane that is perpendicular to a cover unit of the dispensing unit when the dispensing unit is oriented in the received position. The cover unit may be positioned in a plane of the surface of the door and may be configured to cover a space in the door in which the dispensing unit is received when the dispensing unit is oriented in the received position.

The diameter of the first following gear may be smaller than the diameter of the second following gear. The diameter of the driving gear may be smaller than the diameter of the first following gear and the diameter of the second following gear. The first following gear may have a circular arc shape with a central angle of less than 360 degrees being defined between radial axes extending from a rotation axis of the arc and endpoints of the first following gear periphery. A first end of the first following gear may be connected at the rotation axis, a second end of the first following gear may be connected with the dispensing unit, and the first following gear may be configured to rotate about the rotation axis in response to the driving gear being driven by the motor. The second following gear may include a sliding unit that extends in a radial direction and includes a sliding slot configured to receive a sliding protrusion positioned at a side of the dispensing button unit is received. The sliding unit may be configured to move the dispensing button unit by applying force to the sliding protrusion when the sliding protrusion is received in the sliding slot.

In some examples, when the dispensing unit is oriented in the received position and the dispensing button unit is oriented in the stored position, the dispenser outlet of the dispensing unit and the dispensing button unit are positioned in a receiving space defined within the door and received in a dispenser receiving unit that defines, in the surface of the door, an opening through which the dispenser outlet of the dispensing unit moves when the dispensing unit moves from the dispensing position to the received position and through which the dispensing button unit moves when the dispensing button unit moves from the extended position to the stored position. In these examples, the opening defined by the dispenser receiving unit may be covered by the dispensing unit when the dispensing unit is oriented in the received position.

DETAILED DESCRIPTION

Figure 1:
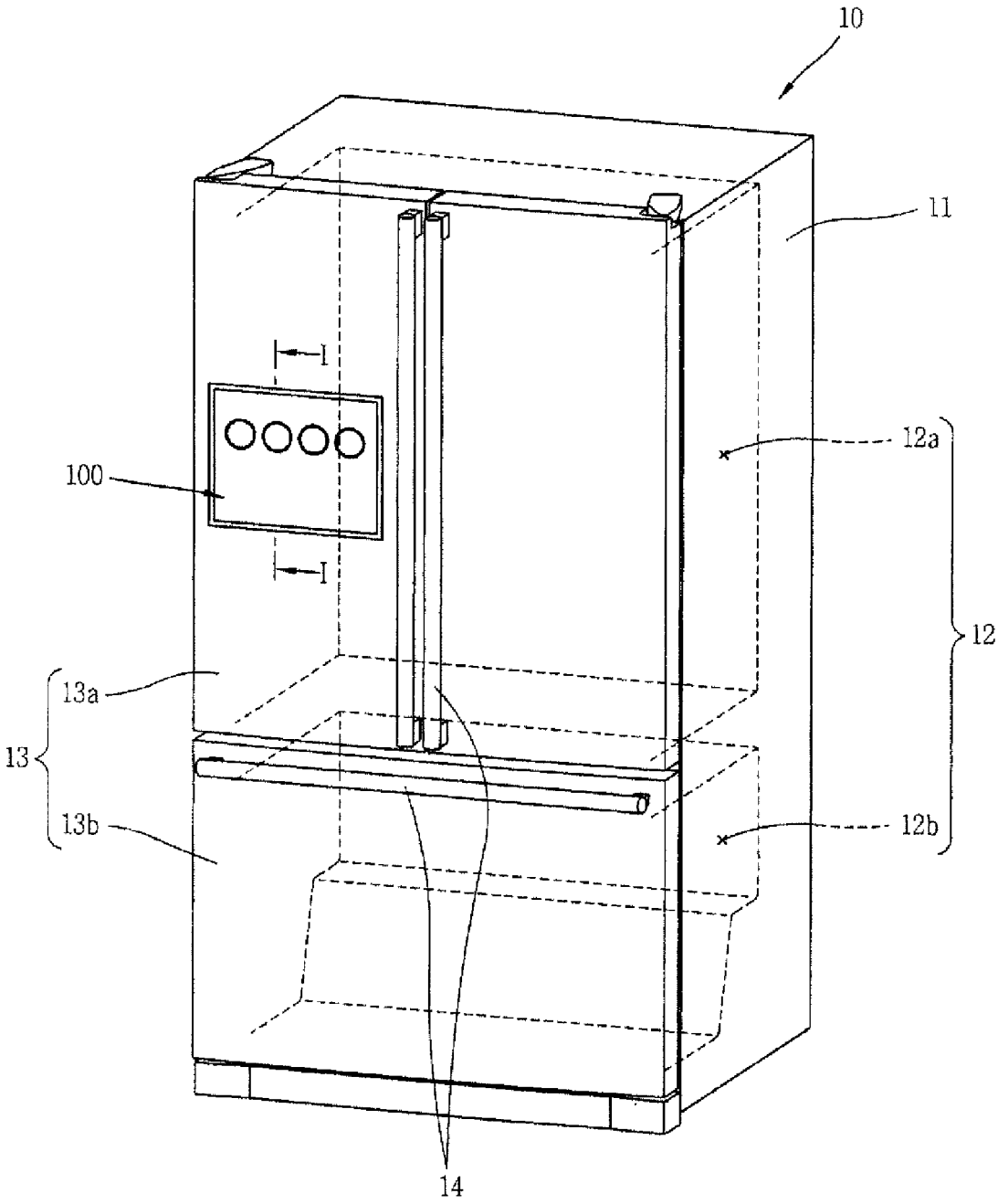
FIG. 1 is a view showing a refrigerator having a dispenser.
Figure 2:
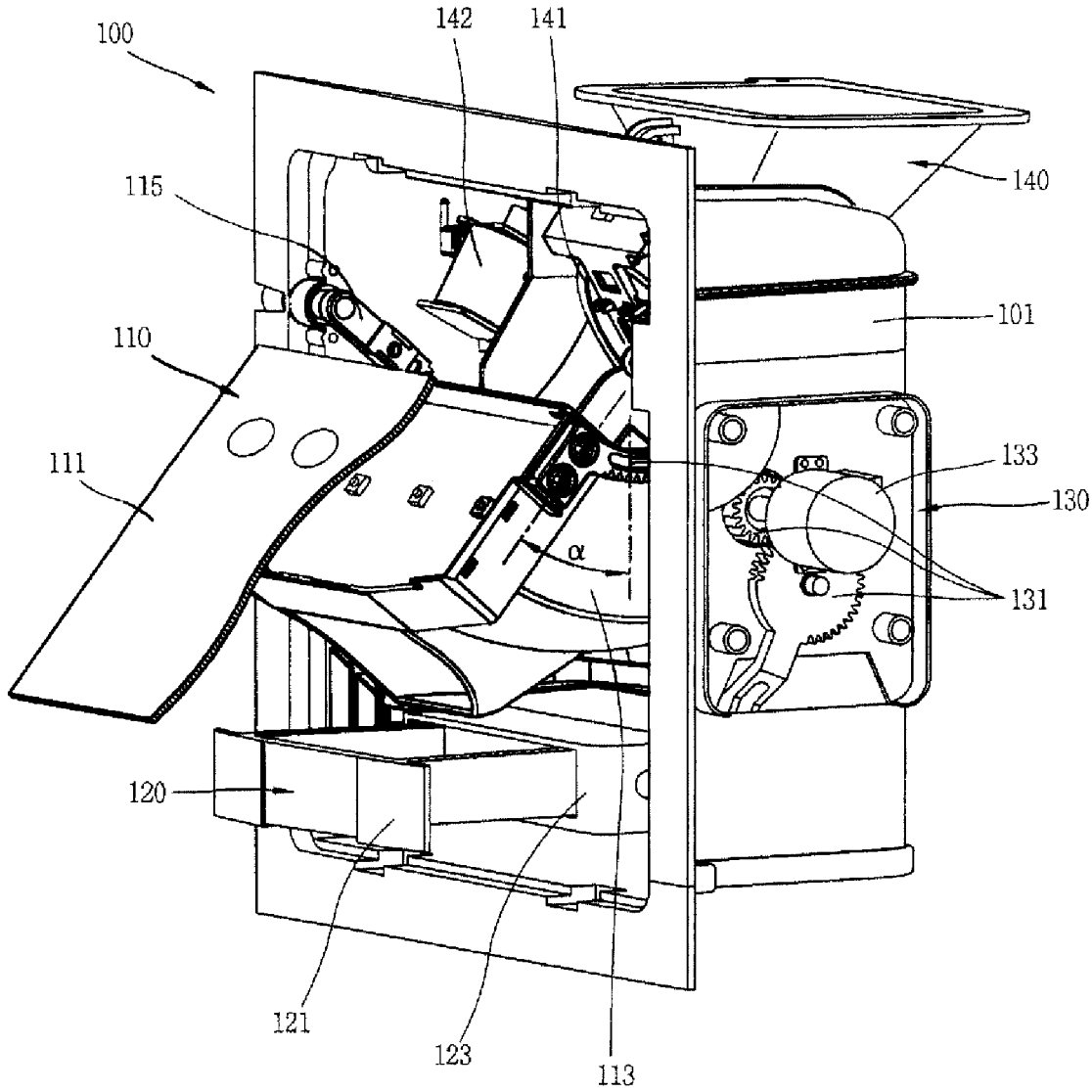
FIG. 2 is a perspective view showing an internal structure of the dispenser in FIG. 1.
Figure 3:
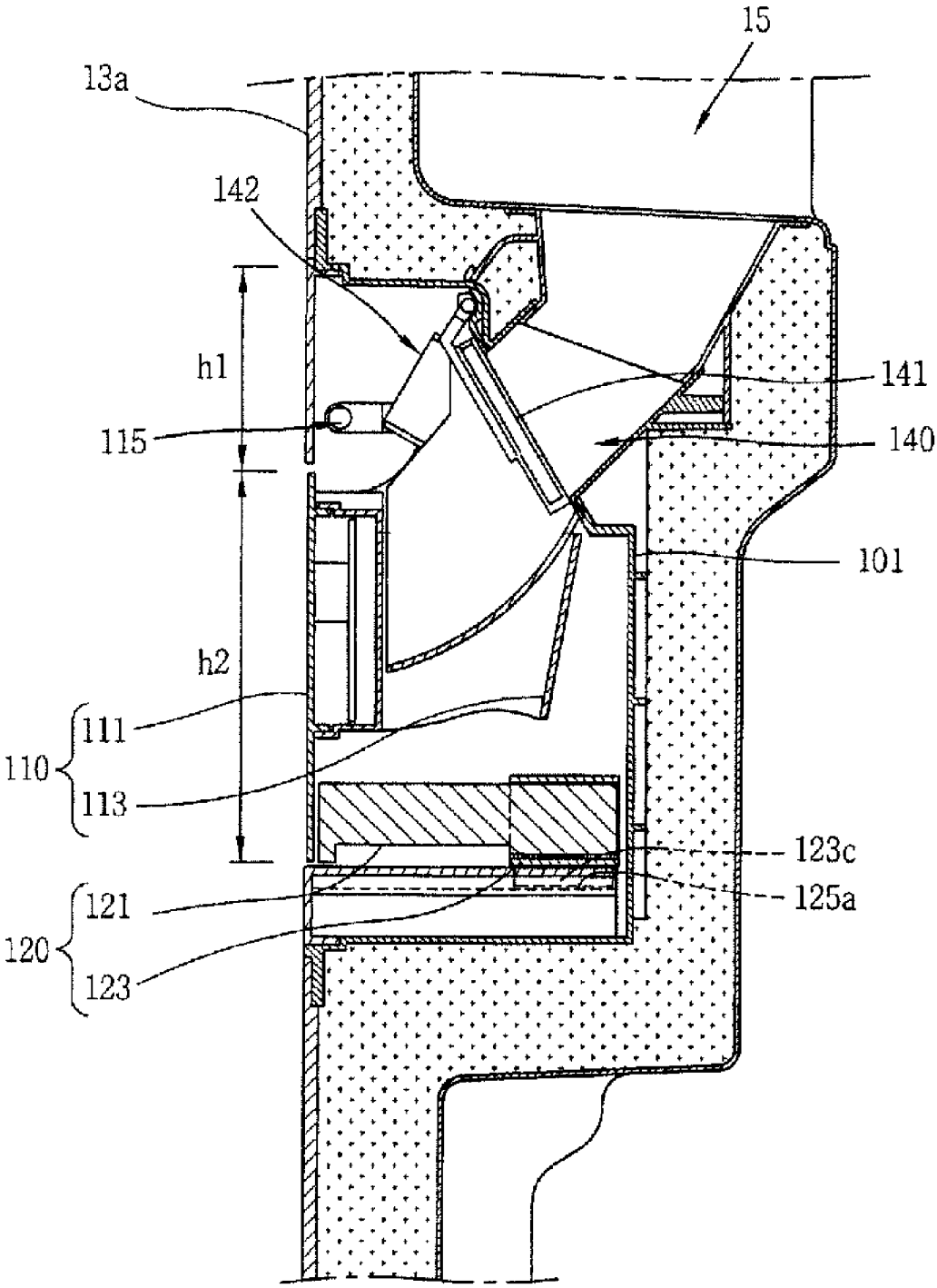
FIG. 3 is a sectional view taken along line I-I in FIG. 1.

FIG. 1 illustrates a refrigerator having a dispenser, FIG. 2 shows an internal structure of the dispenser in FIG. 1, and FIG. 3 illustrates a sectional view of the dispenser taken along line I-I in FIG. 1.

With reference to FIGS. 1 to 3, a refrigerator 10 includes a cooling chamber 12 that stores storage items and a door 13 that shields the cooling chamber.

The cooling chamber 12 is positioned within a main body 11 that defines an external appearance of the refrigerator 10. A gap exists between an inner surface of the cooling chamber 12 and an outer surface of the main body 11, and a heat insulator is positioned within the gap.

The interior of the cooling chamber 12 is insulated from the exterior of the main body 11 by the heat insulator.

Also, one side of the cooling chamber 12 is exposed (e.g., vacant, opened, etc.) to allow items to be put in or taken out, and such one side is covered by a door 13 that is connected to the main body 11 by hinges that enable opening and closing of the door 13.

Because a heat insulator is inserted in the door 13, heat transfer to the cooling chamber 12 via the door 13 can be reduced.

A door handle 14 may be coupled to a portion of a front surface of the door 13 to allow a user to grasp it, and use the door handle 14 to open and close the door 13.

A refrigerating cycle (not shown) for generating cooling air to cool the cooling chamber 12 is provided at one side of the main body 11.

Several mechanisms exist for the construction and operation of the refrigerating cycle, and, therefore, a detailed description on the refrigerating cycle will be omitted. Any of mechanism may be used for the refrigerating cycle of the refrigerator 10.

The cooling air generated by the refrigerating cycle may be supplied to the cooling chamber 12 via a cooling air supply duct (not shown) formed within the main body 11 to cool the interior of the cooling chamber 12.

Of course, an air blower (not shown) may be provided to smoothly supply cooling air through the cooling air supply duct.

The cooling chamber 12 may include a refrigerating chamber 12*a* that freshly keeps storage items in storage without freezing them and a freezing chamber 12*b* that keeps storage items in a frozen state in storage for a long period.

Also, the refrigerating chamber 12*a* and the freezing chamber 12*b* may have various types of specific configurations (or structures) such that consumers may select the configuration they desire based upon how they use their refrigerator or based upon the types or amount of things (food) to be stored therein.

FIG. 1 shows an example of the refrigerator 10 in an ordinary operating orientation. For instance, as shown, when a support structure of the refrigerator 10 rests against the ground, the refrigerating chamber 12*a* is positioned at a relatively upper portion of the main body 11 and the freezing chamber 12*b* is positioned at a relatively lower portion of the main body 11. The ordinary operating orientation may reflect the intended orientation of the refrigerator 10 when being used by a consumer.

In some implementations, as shown in FIG. 1, because users typically access the refrigerating chamber 12*a* more than the freezing chamber 12*b*, the refrigerating chamber 12*a* may be provided at an upper portion and the freezing chamber 12*b* may be provided at a lower portion such that user convenience is improved. Also, a freezing chamber door 13*b* for opening and closing the freezing chamber 12*b* may be a pull-out drawer assembly (instead of a hinged assembly used in the refrigerating chamber door 13*a*) such that the user can place items into or remove items from the freezing chamber 12*b* more easily without having to strenuously bend down (or lower his posture) to access the freezing chamber 12*b*.

Alternatively, the freezing chamber 12*b* may be formed at the upper portion and the refrigerating chamber 12*a* may be formed at the lower portion. Of course, the refrigerating chamber 12*a* and the freezing chamber 12*b* may be horizontally oriented and positioned side by side.

A dispenser 100 is provided on the refrigerator 10 to dispense ice or the like made in the cooling chamber 12 from the exterior without opening the door 13.

FIG. 1 shows an example in which the dispenser 100 is provided on the refrigerating door 13*a*, but alternatively, the dispenser 100 may be provided on the freezing chamber door 13*b*.

An ice making unit 15 may be provided within the cooling chamber 12 to make ice or the like to be dispensed via the dispenser 100, and the ice making unit 15 and the dispenser 100 may be installed to be connected with each other.

For this, the ice making unit 15 and the dispenser 100 are connected with each other, and a transfer unit 140 may be provided to transfer ice or the like made by the ice making unit 15 to the dispenser 100.

The ice making unit 15 may be provided within the cooling chamber 12 or on the rear surface of the door 13, namely, the surface facing the cooling chamber 12.

The construction and the operation of the ice making unit 15 may be the same as those of known ice making units, so its detailed description will be omitted.

With reference to FIGS. 2 and 3, in some implementations, the dispenser 100 includes a dispensing unit 110 and a dispensing button unit 120 which are configured to be received at an inner side of a front surface of the door 13 and extended to a front side of the door when ice, water, or the like is dispensed, and a driving unit 130 that allows the dispensing unit 110 and the dispensing button unit 120 to move between a received position and an extended position in a coordinated manner.

The front portion of the door 13 may have a dispenser receiving part 101, which has an opened front and is embedded (e.g., entrenched, set in, etc.) into the door 13 at a certain depth in the thickness direction thereof, to accommodate the dispensing unit 110 and the dispensing button unit 120. At the inner surface of the dispenser receiving part 101, the dispensing unit 110, the dispensing unit button 120, and the driving (operating) unit 130 may be attached and provided thereon.

Alternatively, the dispenser receiving part 101 may be a separate element (having a recessed shape and an opened front) that is installed on the door, such that the dispensing unit 110, the dispensing button unit 120 and the driving unit 130 may be mounted and received.

The transfer unit 140 may be provided at an upper side of the dispenser receiving part 101, allowing an outer side and an inner side of the dispenser receiving part 101 to communicate with each other.

As shown in FIGS. 2 and 3, an opening/closing member 141 for selectively opening the transfer unit 140 when ice or the like needs to be transferred via the transfer unit 140 may be provided at an inner side of the transfer unit 140. One side of the opening/closing member 141 may be hinge-connected with the transfer unit 140 or with the dispenser receiving part 101 and may be rotated by a driving unit such as a solenoid 142.

In some implementations, the dispensing unit 110 may include a guide unit 113 for guiding ice, which has been transferred, via the transfer unit 140, to be dispensed, and a cover unit 111 for shielding the opened front side of the dispenser receiving part 101 and having a rear surface to which the guide unit 113 is attached.

The upper end portions of the dispensing unit 110 may be respectively hinge-connected with a corresponding side of the inner surface of the dispenser receiving part 101 so as to be rotatable in a certain direction, such as in the vertical direction (up and down) as shown in the drawings.

In more detail, the dispensing unit 110 is rotated upwardly to move to a dispensing position at which the dispensing unit 110 is ejected forwardly from the door 13, and is rotated downwardly to move to a received position at which the dispensing unit 110 is received in the dispenser receiving part 101.

At the dispensing position, the guide unit 113 is connected with an end of the transfer unit 140 to guide ice or the like transferred via the transfer unit 140 so as to be dispensed to outside.

As shown in FIG. 3, the guide unit 113 is positioned to overlap with the transfer unit 140 at the received position. Accordingly, a space taken by the dispensing unit 110 at the received position may be reduced.

In addition, the cover unit 111 is provided to shield the opened front side of the dispenser receiving part 101 when at the received position.

In some implementations, the opened front of the dispenser receiving part 101 may have a particular height (h2), which is measured from the upper end of the dispensing unit 110 to the lower end of the dispensing button unit 120 provided under the dispensing unit 110, such that the dispensing unit 110 is allowed to be opened and closed, and that the dispensing button unit 120 may be pressed (or pushed) when at the received position.

Accordingly, a dispenser receiving unit 101 may be used as a separate additional element that provides shielding (e.g., blocking, covering, etc.) between the bottom end of the transfer unit 140 and the upper portion of the dispensing unit 110 (h1).

Preferably, a hinge connecting portion 115 to which the dispensing unit 110 is coupled is positioned to be higher by a certain length than the upper end of the dispensing unit 110.

Accordingly, the rotation radius of the dispensing unit 110 may be increased without extending the height of the cover unit 111, and thus, the protruding length of the end of the guide unit 113 may be increased at the dispensing position.

Thus, the user may take out ice or water using the dispenser 100. In addition, because a rotation angle of the dispensing unit 110 is reduced, the dispensing unit does not need to be excessively rotated to degrade an aesthetic external appearance in the dispensing operation.

In some examples, in order to reduce detrimental effects of the aesthetic external appearance at the dispensing position, the angle ($\alpha$) between the cover unit 111 and the front surface of the door 13 is maintained within the range of about 45° to 60°.

The cover unit 111 may be positioned on the same plane (level) as the surface of the door 13 at the received position.

The dispensing button unit 120 includes a button frame unit 123 that is moved, by the driving unit 130, in a planar manner into or out of the dispenser receiving part 101 according to a movement of the dispensing unit 110, and a button unit 121 that is elastically supported by the button frame unit 123 and that is configured to control the dispensing operation based on force applied to the button unit 121.

The dispensing button unit 120 is positioned below the dispensing unit 110.

Thus, when the button unit 121 is pressed or pushed in by using a container (or cup) being held by a user, the lip (or opening) of the container (or cup) may be aligned with a bottom edge of the guide unit 113.

The driving unit 130 may include a gear unit 131 having a plurality of gears connected with the dispensing unit 110 and the dispensing button unit 120 and a motor 133 that transfers power to the gear unit 131.

Accordingly, the movement of the dispensing unit 110 and that of the dispensing button unit 120 are controlled according to rotation of the motor 133.

As shown in FIGS. 1-3, the dispensing unit 110 and the dispensing button unit 120 are ejected in front of the door 13 by a driving unit 130 to dispense ice from the cooling chamber 12. Because the dispensing unit 110 and the dispensing button unit 120 are ejected in front of the door 13 by the driving unit 130 to dispense ice from the cooling chamber, the space taken by the dispenser 100 may be reduced (e.g., minimized), and accordingly, a reduction in the volume of the cooling chamber 12 caused by the dispenser may be reduced (e.g., minimized).

Figure 4:
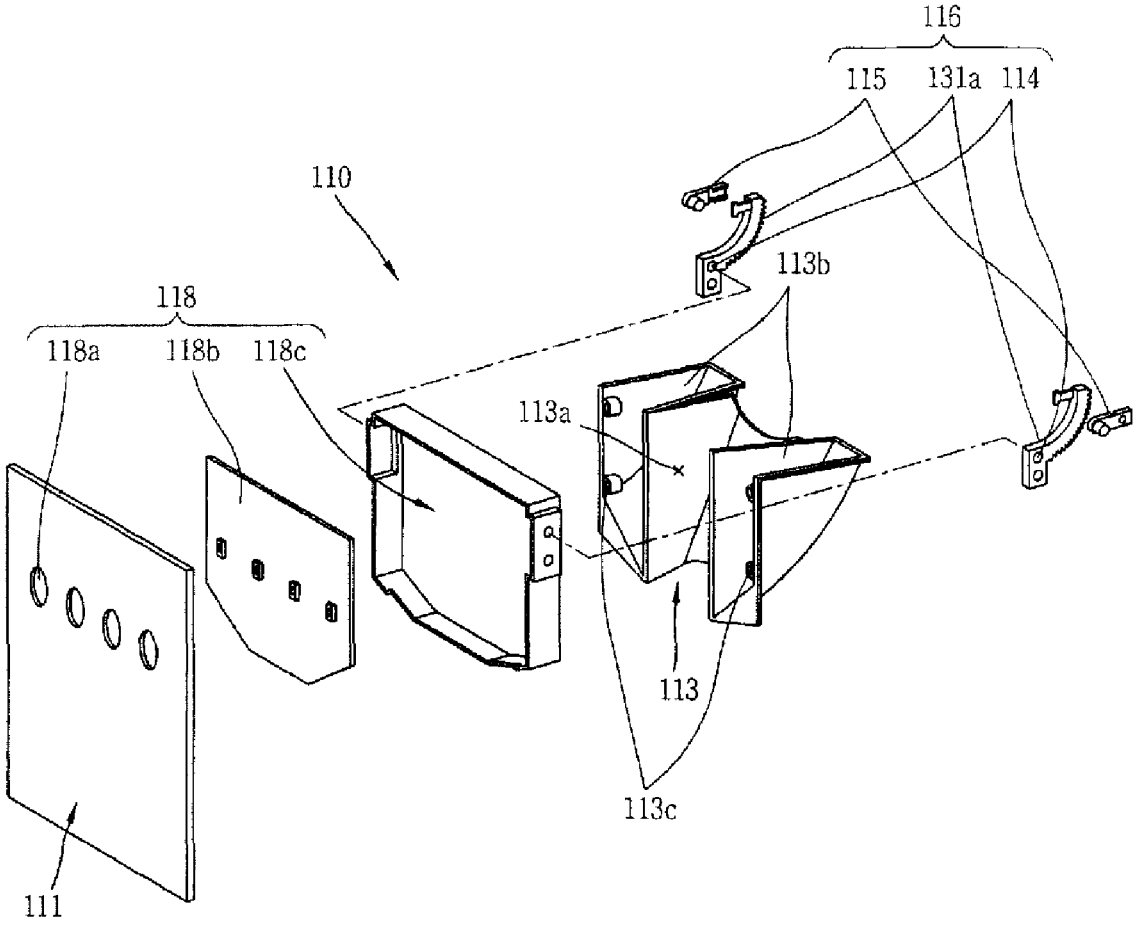
FIG. 4 is an exploded perspective view of a dispensing unit.

FIG. 4 shows a dispensing unit As shown in FIG. 4, the dispensing unit 110 includes the cover unit 111 and the guide unit 113 that is attached with the rear surface of the cover unit 111 and that guides dispensed ice or the like as described above.

The dispensing unit 110 may include a control button unit 118 that controls the operation of the dispenser 100. The control button unit 118 includes a button PCB (Printed Circuit Board) 118*b* that generates a control signal when pressed by the user, a button receiving unit 118*a* positioned at the cover unit 111 and configured to transfer a pressing force to the button PCB 118*b*, and a PCB receiving unit 118*c* in which the button PCB 118*b* is received and fixed.

The control button unit 118 is attached to a rear surface of the cover unit 111 and the guide unit 113 is attached to a rear surface of the control button unit 118.

The guide unit 113 includes a guide 113*a* configured to be attached to the rear surface of the control button unit 118 to define a movement path to guide dispensed ice or the like and guide fixing units 113*b* provided at both sides of the guide 113*a* and having fastening units 113*c* configured to attach to the control button unit 118.

One end of a hinge connecting member 116 that couples the dispensing unit 110 to the dispenser receiving part 101 is fixed to the side surface of the dispensing unit 110, namely, both ends of the rear surface of the cover unit 111, the both side surfaces of the control button unit 118, or the side surface of the guide fixing unit 113*b*. The other end of the hinge connecting member 116 is coupled with the dispenser receiving part 101.

The hinge connecting member 116 rotates the dispensing unit 110 upon receiving power from the driving unit 130.

The hinge connecting member 116 will be described in more detail below.

Figure 5:
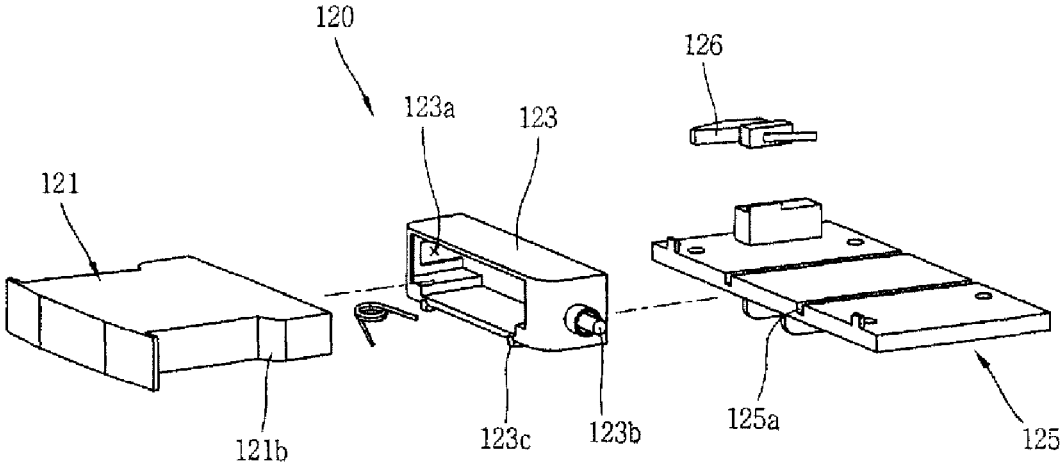
FIG. 5 is an exploded perspective view of a dispensing button unit.

FIG. 5 illustrates a dispensing button unit.

As shown in FIG. 5, in some implementations, as described above, the dispensing button unit 120 includes the button frame unit 123 that horizontally moves in or out of the dispenser receiving part 101 by the driving unit 130 and the button unit 121 elastically supported by the button frame unit 123.

The dispensing button unit 120 may further include a frame movement guide unit 125 that guides a horizontal movement of the button frame unit 123 and reduces lateral movement of the button frame unit 123.

The button unit 121 is supported by the button frame unit 123 in an elastic manner due to a restoring force that is biased in a forward direction with respect to the dispenser receiving part 101.

Thus, in order to limit movement of the button unit 121 forwardly of the dispenser receiving part 101 by the restoring force, a stop end 121*b* is positioned at a rear end of the side of the button unit 121 and a button unit stop recess 123*a* is positioned at the side of the button frame unit 123 such that it corresponds to the stop end 121*b*.

The stop end 121*b* and the button unit stop recess 123*a* may be installed on any portion of the upper or lower surfaces without being limited to the side.

A switching member 126 is installed on a movement path along which the rear end of the side of the button unit 121 moves, and pressed by the movement of the button unit 121 to generate an operation signal of the dispenser 100.

In this case, the switching member 126 may be fixedly provided on an inner side of the dispenser receiving part 101.

Alternatively, the switching member 126 may be fixed to the frame movement guide unit 125. In this example, the lateral movement of the button frame unit 123 may be reduced by the frame movement guide unit 125, thereby enhancing contact reliability between the button unit 121 and the switching member 126.

The frame movement guide unit 125 is positioned on a lower surface of the button frame unit 123 and fixed to a lower surface of an inner side of the dispenser receiving part 101. On the contact surfaces of the frame movement guide unit 125 and the button frame unit 123, a button guiding protrusion 123*c* and a button guiding groove 125*a* are provided in a corresponding manner in the movement direction of the button frame unit 123.

The button frame unit 123 allows the button unit 121 to be inserted and elastically supported therein, and a sliding protrusion 123*b* is positioned at an outer side of the button frame unit 123 and coupled with the driving unit 130 to drive the horizontal movement of the button frame unit 123.

Figure 6:
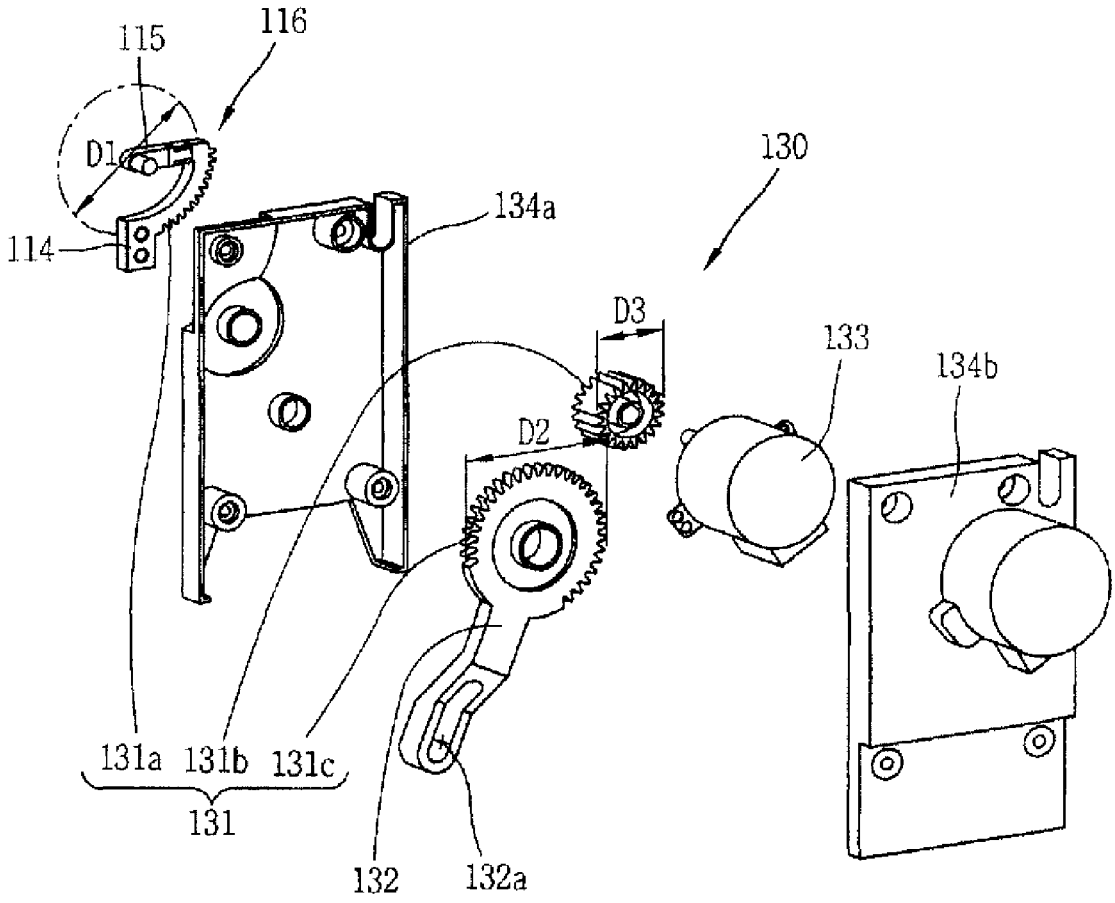
FIG. 6 is an exploded perspective view of a driving unit.
Figure 7:
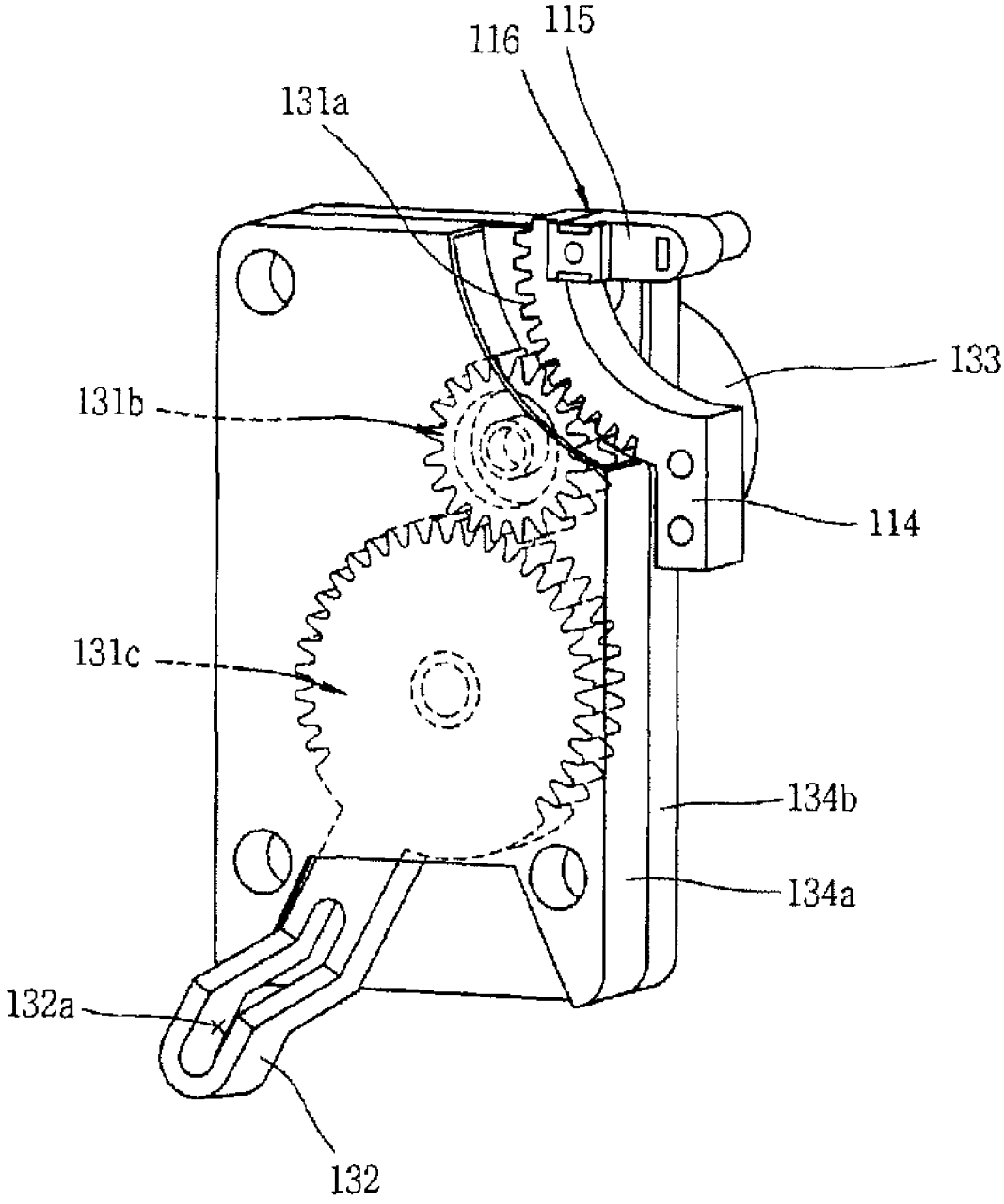
FIG. 7 is a perspective view of an assembled state of the driving unit in FIG. 6.

FIG. 6 illustrates a driving unit in FIG. 2, and FIG. 7 shows an assembled state of the driving unit in FIG. 6.

With reference to FIGS. 6 and 7, in some implementations, as described above, the driving unit 130 includes the gear unit 131 having a plurality of gears connected with the dispensing unit 110 and the dispensing button unit 120 and the motor 133 for transferring power to the gear unit 131.

The gear unit 131 includes a driving gear 131*b* that is coupled with the motor 133 such that the driving gear 131*b* rotates in response to force applied by the motor 133, a first following gear 131*a* that is coupled with the driving gear 131*b* to rotate the dispensing unit 110, and a second following gear 131*c* that is coupled with the driving gear 131*b* to move the dispensing button unit 120.

Here, the driving gear 131*b*, the first following gear 131*a*, and the second following gear 131*c* may be installed such that their rotation surfaces are perpendicular to the cover unit 111 (as can be seen from the Figures).

In some examples, a diameter D1 of the first following gear 131*a* is smaller than a diameter D2 of the second following gear 131*c*. In these examples, the angular velocity of the first following gear 131*a* is larger than that of the second following gear 131*c* according to the rotation of the driving gear 131*b*, so there is a difference between an ejecting speed of the dispensing unit 110 and that of the dispensing button unit 120. This arrangement may reduce a problem of the movement of the dispensing button unit 120 being interfered with by the cover unit 111.

In addition, the diameter D3 of the driving gear 131*b* may be smaller than the diameters D1 and D2 of the first following gear 131*a* and the second following gear 131*c*.

The driving gear 131*b* is rotated by the motor 133 and enabling the rotation of the driving gear 131*b* to be maintained at a relatively low speed may allow for the dispensing unit 110 and the dispensing button unit 120 to be smoothly ejected or retracted with minimal noise. The use of a motor having a low rotation speed, however, may be costly and complicated.

Thus, by allowing the driving gear 131*b* to have a smaller diameter, the ejecting speed of the dispensing unit 110 and the dispensing button unit 120 may be reduced by using a rotation speed ratio.

The driving gear 131*b*, the second following gear 131*c* and the motor 133 are positioned within the first and second cover units 134*a* and 134*b* which are matched to connect with each other, and a portion of the driving gear 131*b* is exposed through one portion of the first cover unit 134*a*, where the first following gear 131*a* is engaged.

The first following gear 131*a* is connected with the hinge connecting portion 115 and a fixing portion 114 to constitute the hinge connecting member 116. The hinge connecting member 116 has a circular arc shape with a certain central angle. One end of the first following gear 131*a* is connected with the hinge connecting portion 115, which is connected with the dispenser receiving part 101, and the other end thereof is connected with the fixing portion 114.

The certain central angle may be larger than the angle ($\alpha$) at which the cover unit 111 moves.

The fan-shaped internal space defined by connection of the hinge connecting potion 115 and the first following gear 131*a* serves to prevent an upper end of the cover unit 111 from being interfered with by a lower end of a front portion 101*a* of the dispenser receiving part 101 when the dispensing unit 110 is rotatably ejected.

The first following gear 131*a*, which is provided at one side portion (among the two side portions of the dispensing unit 110) that is not connected with the driving gear 131*b*, is supported by an idle gear provided at a side portion of the dispenser receiving part 101 and rotates in a corresponding manner with the first following gear 131*a*.

The second following gear 131*c* includes a sliding lever portion 132 extending in a radius direction and driving a horizontal movement of the button frame unit 123.

The sliding lever portion 132 includes a sliding slot 132*a* in a lengthwise direction, and a sliding protrusion 123*b* extending from the side of the button frame unit 123 is inserted into the sliding slot 132*a*.

Accordingly, the sliding lever portion 132 pushes the sliding protrusion according to the rotation of the second following gear 131*c*, and in response to rotation of the second following gear 131*c*, the sliding protrusion 123*b* is horizontally moved along the sliding slot 132*a*.

Figure 8:
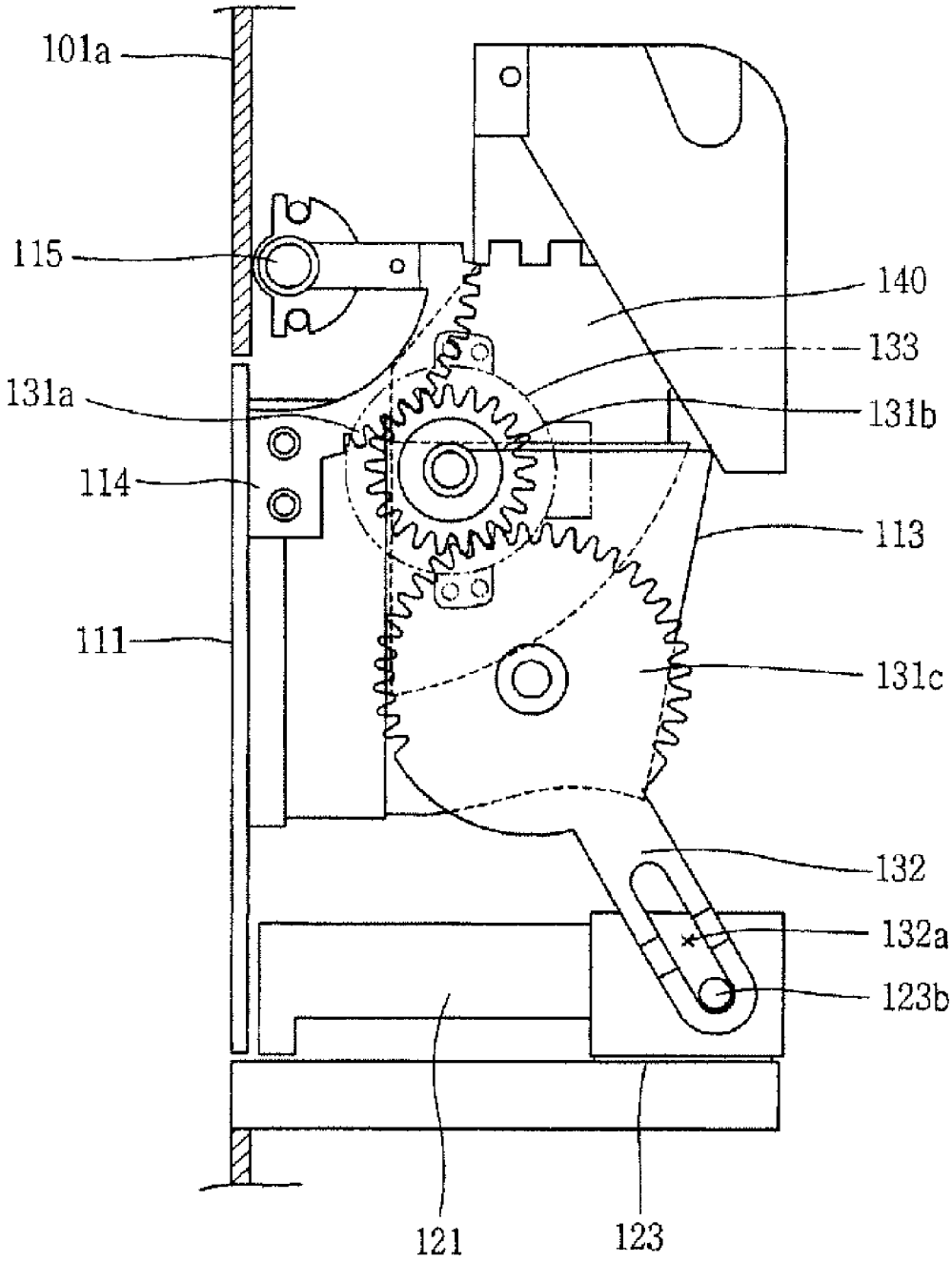
FIG. 8 is a side view of the driving unit of the dispenser at a received position.
Figure 9:
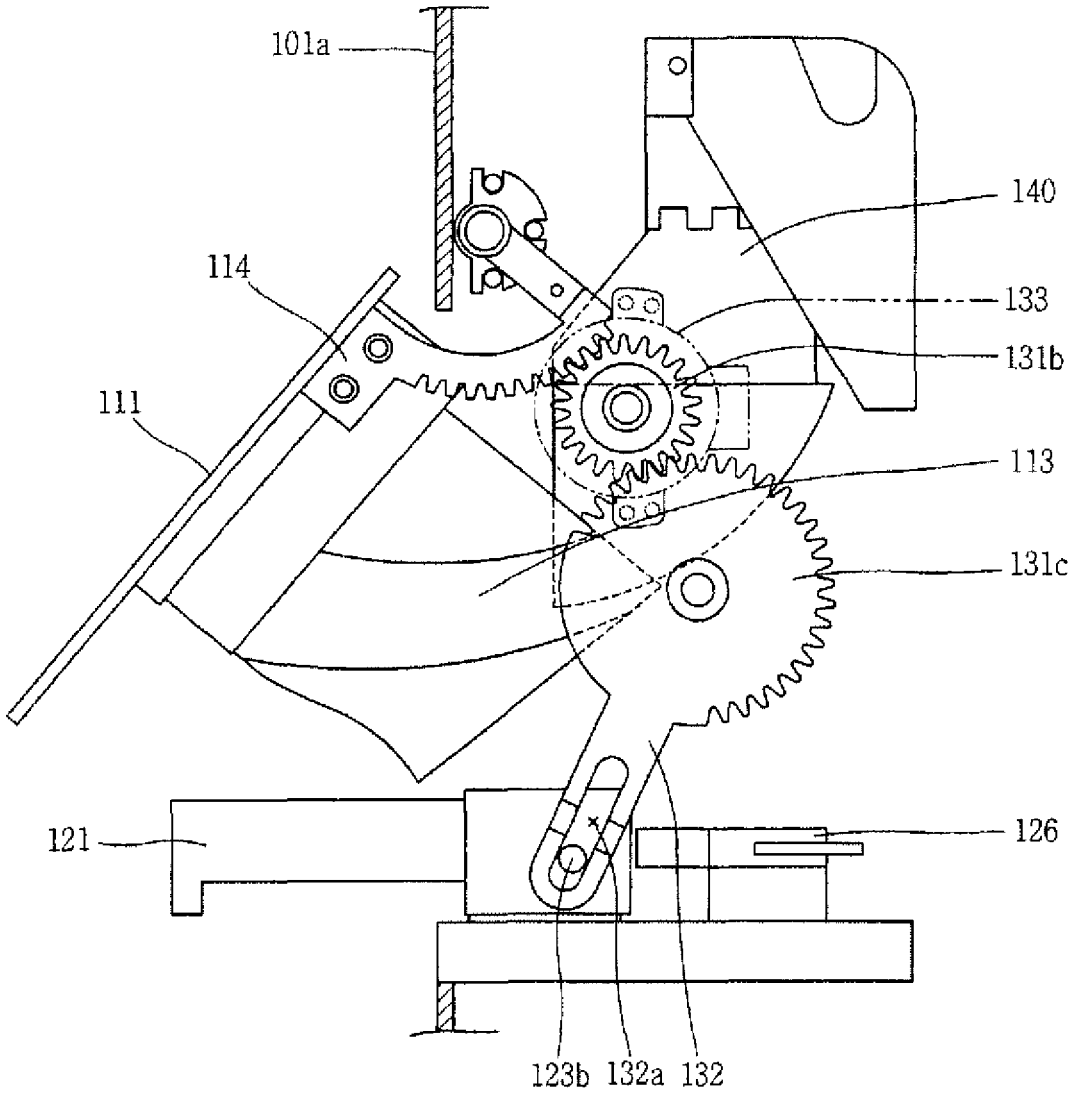
FIG. 9 is a side view of the driving unit of the dispenser at a dispensing position.

FIG. 8 shows a dispenser at a received position, and FIG. 9 shows a dispenser at a dispensing position.

With reference to FIGS. 8 and 9, according to some implementations, the dispenser 100 is completely shielded by the cover unit 111 at the received position of the door 13 when viewed from an outer side of the refrigerator 10. As such, when the dispenser is not in use, the dispensing unit and the dispensing button unit are received at the inner side of the door and shielded by the cover unit, so that contamination, by dust, etc., of the dispensing unit and the dispensing button unit may be reduced (e.g., prevented). Moreover, when the dispenser is not in use, the cover unit is positioned on the same plane as the front surface of the door, shielding the interior, so that the external appearance of the refrigerator may be aesthetically improved.

Figure 10:
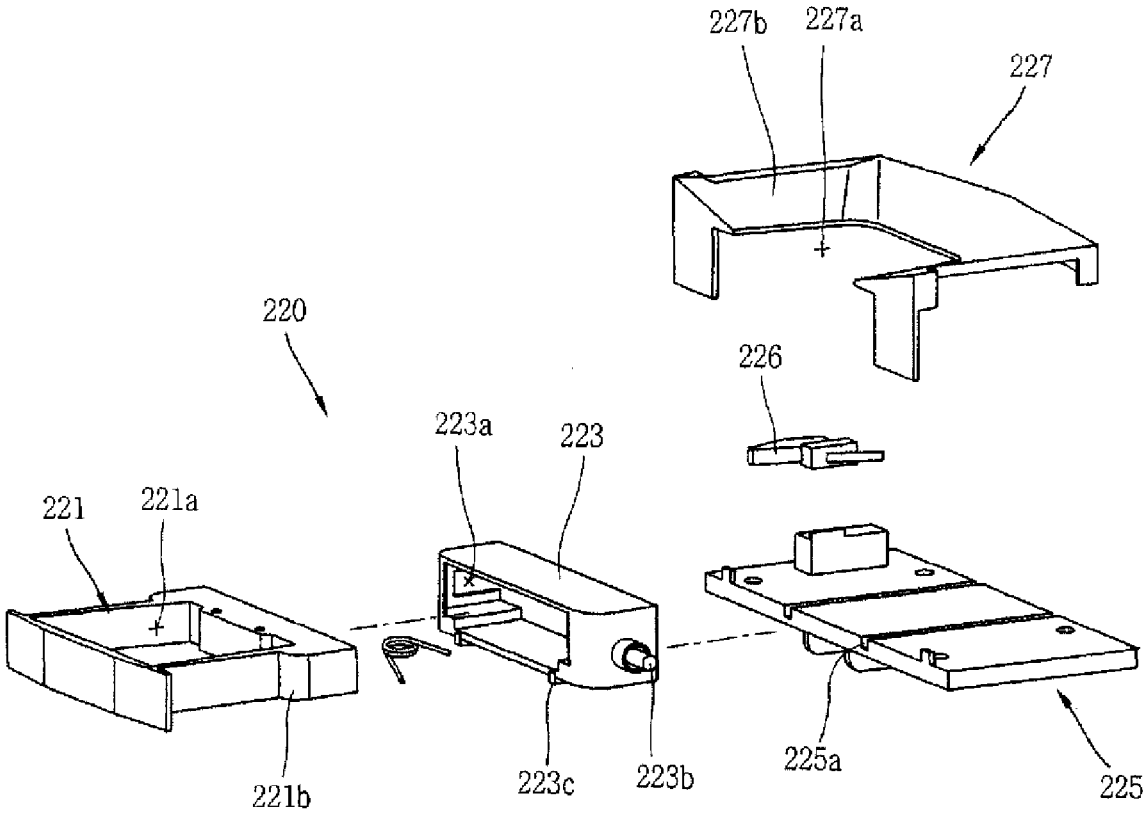
FIGS. 10-12 are exploded perspective views of examples of a dispensing button unit.

As shown in FIG. 10, when the dispenser is in the received position, the guide unit 113 is positioned to overlap with the transfer unit 140, and the dispensing button unit 120 is received to the inner side of the dispenser receiving part 101 by the sliding lever portion 132.

In the received position, when an input signal of the user is transferred via the control button unit 118 provided at the cover unit 111, the driving gear 131*b* is rotated counterclockwise based on the illustration in FIG. 10 by the motor 133 and the first following gear 131*a* and the second following gear 131*c*, which are coupled with the driving gear 131, are rotated clockwise, respectively.

Accordingly, the cover unit 111 and the guide unit 113 are rotated based on the hinge connecting portion 115 as a central shaft and thereby ejected from the dispenser receiving part 101.

Also, as the sliding protrusion 123*b* moves along the sliding slot 132*a* positioned at the sliding lever portion 132, the button frame unit 123 horizontally moves outward from the dispenser receiving part 101 to an extended position.

Thereafter, when the button unit 121 is pressed by the user, the switching member 126 positioned on the movement path of the button unit 121 is pressed by the button unit 121 to generate an ice dispense signal, a water dispense signal, or the like.

Accordingly, ice, water, or the like is transferred through the transfer unit 140 and dispensed externally through the guide unit 113.

The movement from the dispensing position (opened configuration) to the received position (closed configuration) is the opposite to that of the dispensing operation described above.

FIG. 10 illustrates a dispensing button unit. In the following description, any structure and detailed description that would overlap with those already described above may be similar to the structure described above.

In a refrigerator, a dispenser may have the same structure as that of the dispenser 100, except that the dispenser includes a dispensing button unit 220.

With reference to FIG. 10, in the present exemplary embodiment, the dispensing button unit 220 includes a button frame unit 223 that horizontally moves into or out of a dispenser receiving unit by a driving unit and a button unit 221 elastically supported by the button frame unit 223. The dispensing button unit 220 may further include a frame movement guide unit 225 that guides a horizontal movement of the button frame unit 223 and reduces lateral movement of the button frame unit 223.

The button unit 221 is supported by the button frame unit 223 in an elastic manner due to a restoring force that is biased in a forward direction with respect to the dispenser receiving part.

Thus, in order to limit movement of the button unit 221 to the front side of the dispenser receiving part by the restoring force, a stop end 221*b* is positioned at a rear end of the side of the button unit 221 and a button unit stop recess 223*a* is positioned at the side of the button frame unit 223 such that it corresponds to the stop end 221*b*.

A switching member 226 is installed on a movement path along which the rear end of the side of the button unit 221 moves, and pressed by the movement of the button unit 221 to generate an operation signal of the dispenser.

The frame movement guide unit 225 is positioned on a lower surface of the button frame unit 223 and fixed to a lower surface of an inner side of the dispenser receiving part. On the contact surfaces of the frame movement guide unit 225 and the button frame unit 223, a button guiding protrusion 223*c* and a button guiding groove 225*a* are provided in a corresponding manner in the movement direction of the button frame unit 223.

The button frame unit 223 allows the button unit 221 to be inserted and elastically supported therein, and a sliding protrusion 223*b* is positioned at an outer side of the button frame unit 223 and coupled with the driving unit to drive the horizontal movement of the button frame unit 223.

The button unit 221 further includes a residual ice (or water) receiving unit 221*a* that is depressed from an upper surface of the button unit 221 toward a lower surface of the button unit 221.

The dispensing button unit 220 further includes a residual ice guide unit 227 that is positioned at the upper side of the dispensing button unit 220 and guides ice or the like which is abnormally dispensed from the guide unit to the residual ice receiving unit 221*a*.

For example, the residual ice guide unit 227 includes an opening 227*a* to allow ice to be transferred at an inner side thereof and a slope portion 227*b* configured to be downwardly sloped at the circumference of the opening 227*a* to guide ice dispensed to the opening 227*a*.

In some implementations, the opening 227*a* of the residual ice guide unit 227 is fixed at a certain position of an upper portion of the dispensing button unit 220 such that it corresponds to the residual ice receiving unit 221*a* when the button unit 221 is pressed.

Figure 11:
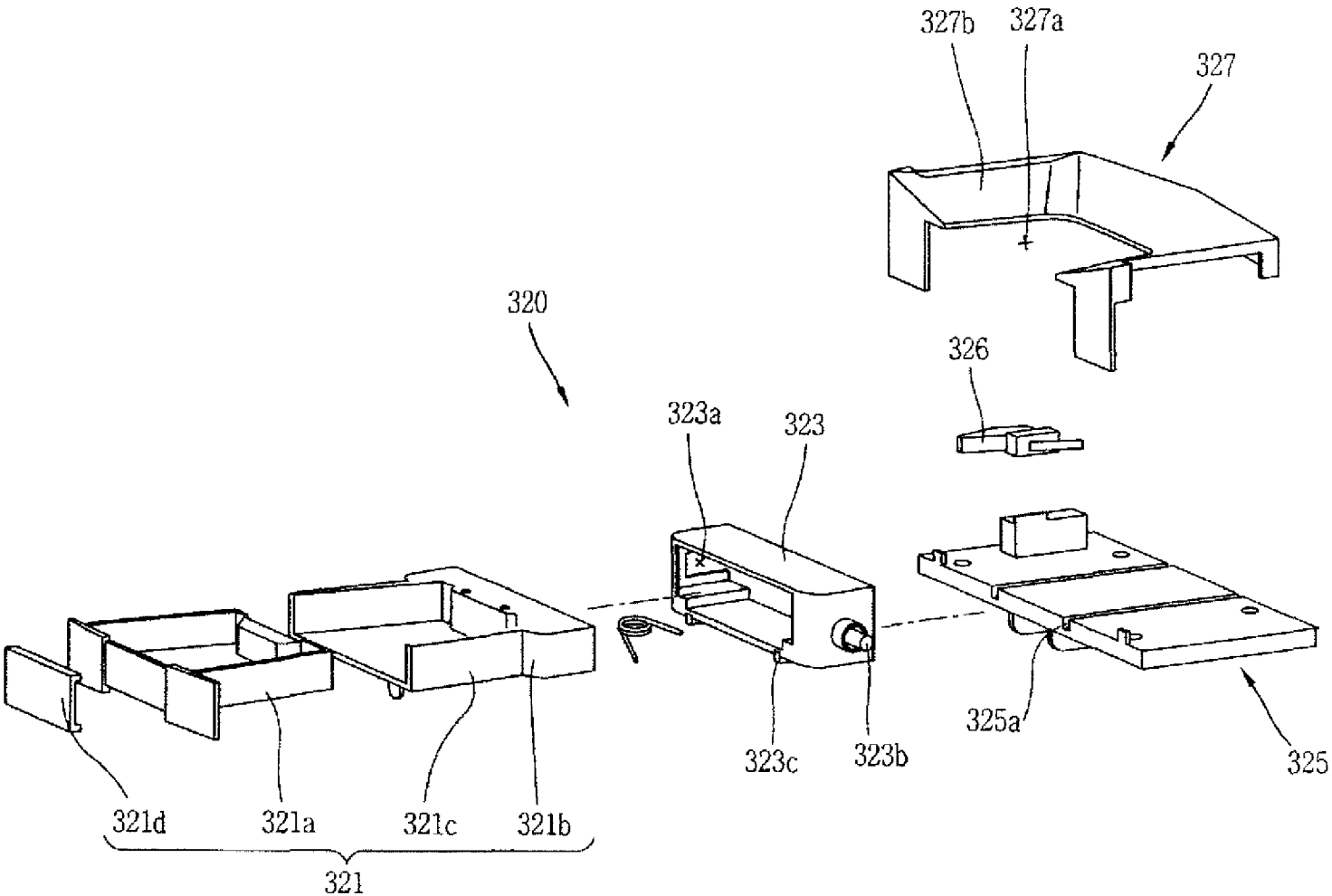

FIG. 11 illustrates a dispensing button unit. In the following description, any structure and detailed description that would overlap with those already described above may be similar to the structure described above.

In a refrigerator, a dispenser may have the same structure as the dispenser 100, except that the dispenser includes a dispensing button unit 320.

With reference to FIG. 11, in some implementations, the dispensing button unit 320 includes a button frame unit 323 that horizontally moves into or out of a dispenser receiving unit by a driving unit and a button unit 321 elastically supported by the button frame unit 323. The dispensing button unit 320 may further include a frame movement guide unit 325 that guides a horizontal movement of the button frame unit 323 and reduces lateral movement of the button frame unit 323.

The button unit 321 is supported by the button frame unit 323 in an elastic manner due to a restoring force that is biased in a forward direction with respect to the dispenser receiving part.

Thus, in order to limit movement of the button unit 321 that moves to the front side of the dispenser receiving part by the restoring force, a stop end 321*b* is positioned at a rear end of the side of the button unit 321 and a button unit stop recess 323*a* is positioned at the side of the button frame unit 323 such that it corresponds to the stop end 321*b*.

A switching member 326 is installed on a movement path along which the rear end of the side of the button unit 321 moves, and pressed by the movement of the button unit 321 to generate an operation signal of the dispenser.

The frame movement guide unit 325 is positioned on a lower surface of the button frame unit 323 and fixed to a lower surface of an inner side of the dispenser receiving part. On the contact surfaces of the frame movement guide unit 325 and the button frame unit 323, a button guiding protrusion 323*c* and a button guiding groove 325*a* are provided in a corresponding manner in the movement direction of the button frame unit 323.

The button frame unit 323 allows the button unit 321 to be inserted and elastically supported therein, and a sliding protrusion 323*b* is positioned at an outer side of the button frame unit 323 and coupled with the driving unit to drive the horizontal movement of the button frame unit 323.

The button unit 321 further includes a residual ice (or water) receiving unit 321*a* that is depressed from an upper surface of the button unit 321 toward a lower surface of the button unit 321 and that is separably movable. The button unit 321 includes a button body 321*c* to which the residual ice receiving unit 321*a* is detachably mounted.

Accordingly, if the residual ice receiving unit 321*a* is filled with much residual ice (or water), the user may release the residual ice receiving unit 321*a* to remove the internal residual ice (or water).

In some examples, a container contact unit 321*d* may be provided as an elastic member on the front surface of the residual ice receiving unit 321*a*, namely, on the face where the container for receiving ice, water, or the like contacts in order to reduce the amount of impact transferred to the container by the restoring force applied to the button unit 321 when the button unit 321 is pressed.

The dispensing button unit 320 further includes a residual ice guide unit 327 that is positioned at the upper side of the dispensing button unit 320 and guides ice or the like which is abnormally dispensed from the guide unit to the residual ice receiving unit 321*a*.

For example, the residual ice guide unit 327 includes an opening 327*a* to allow ice to be transferred at an inner side thereof and a slope portion 327*b* configured to be downwardly sloped at the circumference of the opening 327*a* to guide ice dispensed to the opening 327*a*.

In some implementations, the opening 327*a* of the residual ice guide unit 327 is fixed at a certain position of an upper portion of the dispensing button unit 320 such that it corresponds to the residual ice receiving unit 321*a* when the button unit 321 is pressed.

In a refrigerator, a dispenser may have the same structure as the dispenser 100, except that the dispenser includes a dispensing button unit 420.

Figure 12:
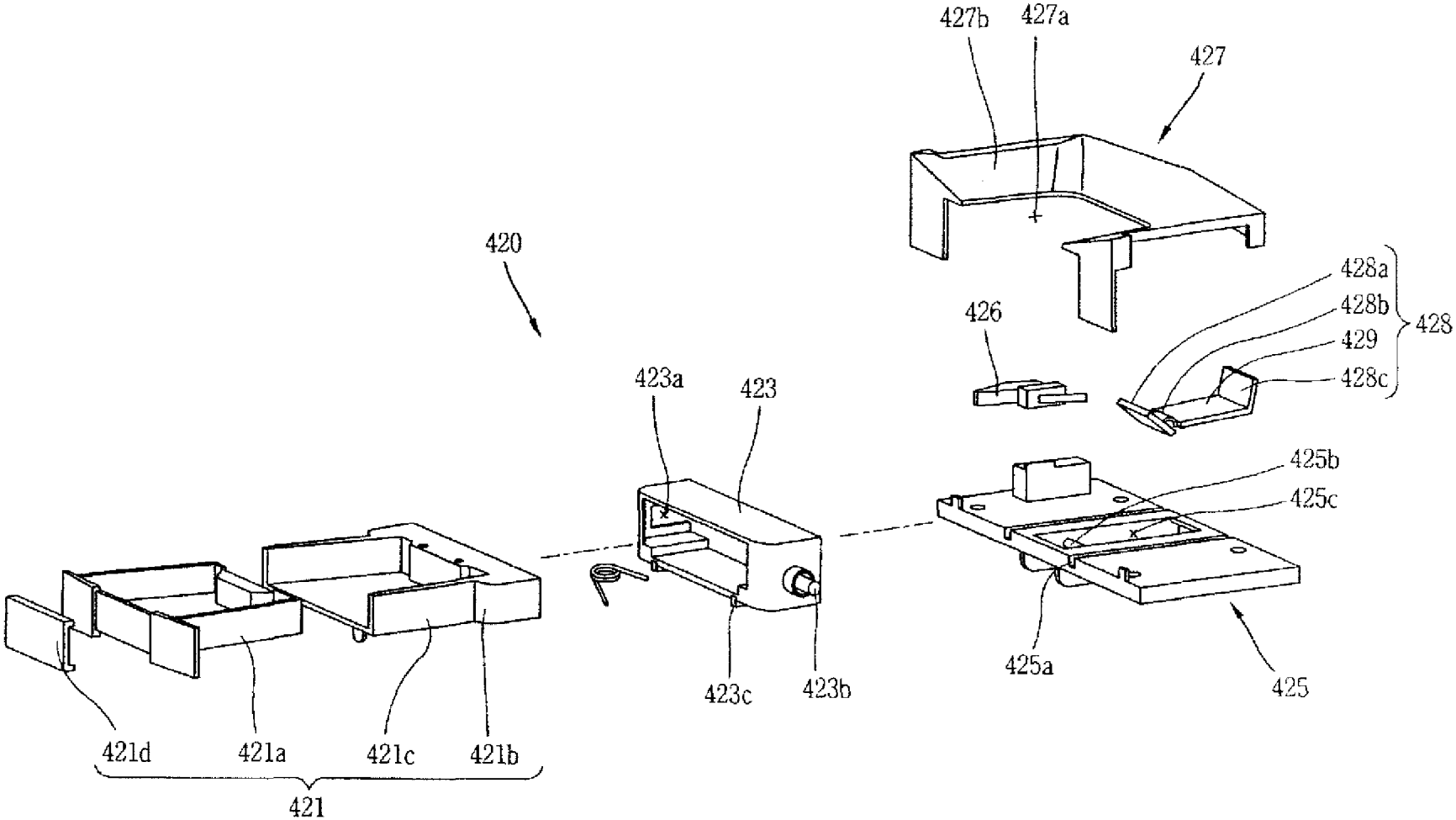
Figure 13:
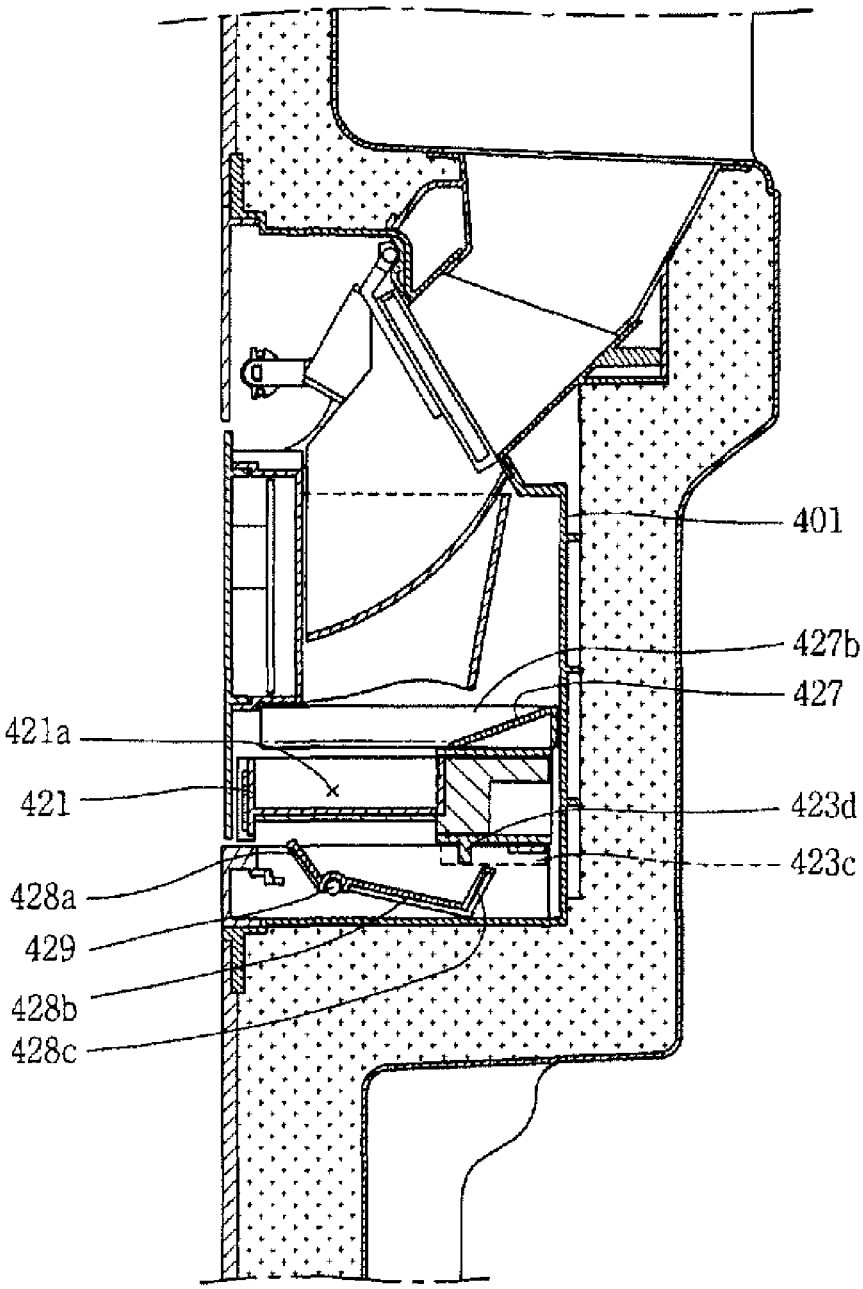
FIG. 13 is a sectional view of the dispensing button unit when the dispenser in FIG. 12 is positioned at the received position.
Figure 14:
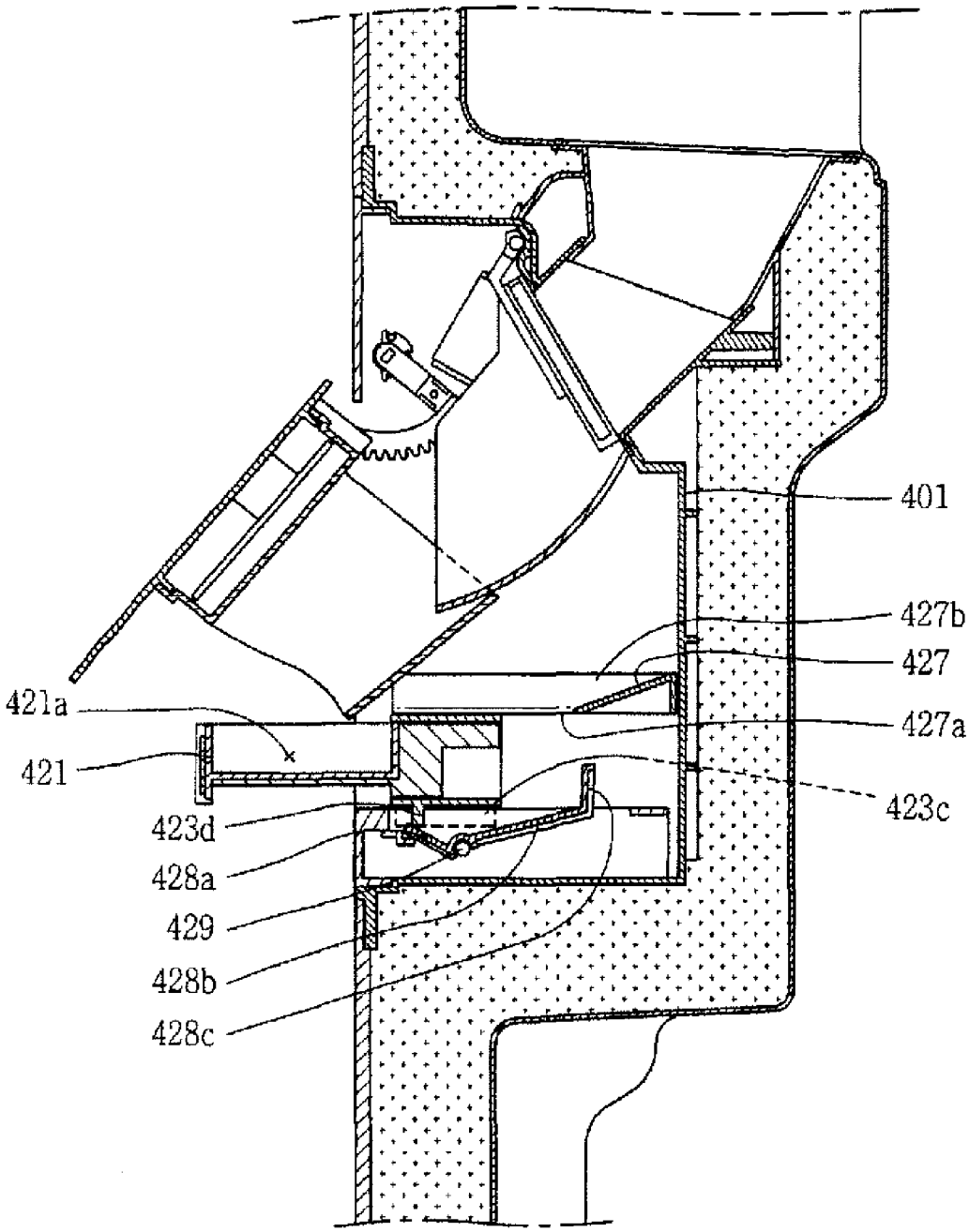
FIG. 14 is a sectional view of the dispensing button unit when the dispenser in FIG. 12 is positioned at the dispensing position.
Figure 15:
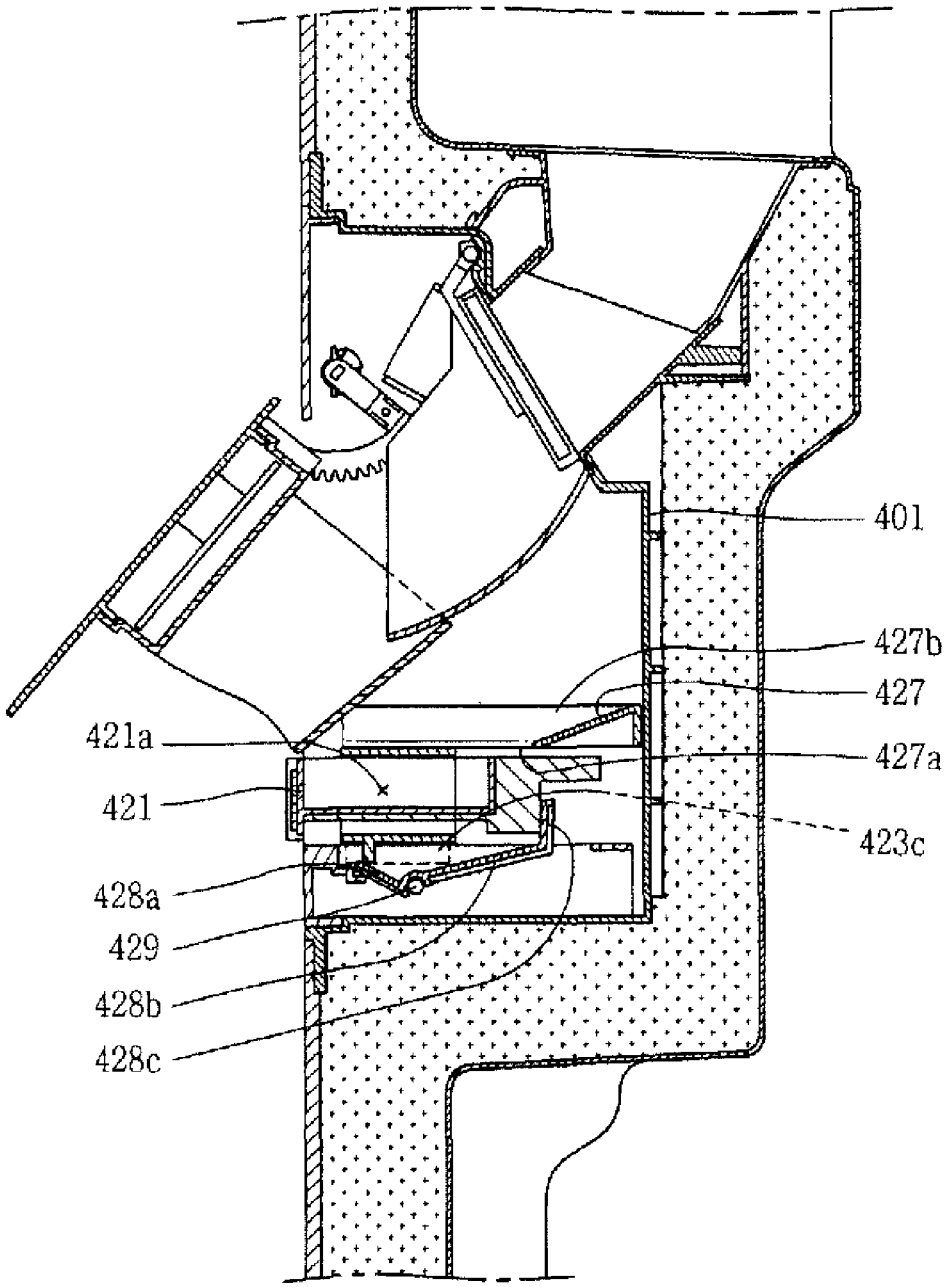
FIG. 15 is a sectional view of a dispensing button unit when the button unit is pressed.

FIG. 12 illustrates a dispensing button unit, FIG. 13 illustrates the dispensing button unit when the dispenser in FIG. 12 is positioned at a received position, FIG. 14 shows the dispensing button unit when the dispenser in FIG. 12 is positioned at a dispensing position, and FIG. 15 shows the dispensing button unit when the button unit is pressed. In the following description, any structure and detailed description that would overlap with those already described above may be similar to the structure described above.

With reference to FIGS. 12 to 15, in some implementations, the dispensing button unit 420 includes a button frame unit 423 that horizontally moves into or out of a dispenser receiving unit 401 by a driving unit 430 and a button unit 421 elastically supported by the button frame unit 423. The dispensing button unit 420 may further include a frame movement guide unit 425 that guides a horizontal movement of the button frame unit 423 and reduces lateral movement of the button frame unit 423.

The button unit 421 is supported by the button frame unit 423 in an elastic manner due to a restoring force that is biased in a forward direction with respect to the dispenser receiving part 401.

Thus, in order to limit movement of the button unit 421 to the front side of the dispenser receiving part 401 by the restoring force, a stop end 421*b* is positioned at a rear end of the side of the button unit 421 and a button unit stop recess 423*a* is positioned at the side of the button frame unit 423 such that it corresponds to the stop end 421*b*.

A switching member 426 is installed on a movement path along which the rear end of the side of the button unit 421 moves, and pressed by the movement of the button unit 421 to generate an operation signal of the dispenser.

The frame movement guide unit 425 is positioned on a lower surface of the button frame unit 423 and fixed to a lower surface of an inner side of the dispenser receiving part 401. On the contact surfaces of the frame movement guide unit 425 and the button frame unit 423, a button guiding protrusion 423*c* and a button guiding groove 425*a* are provided in a corresponding manner in the movement direction of the button frame unit 423.

The button frame unit 423 allows the button unit 421 to be inserted and elastically supported therein, and a sliding protrusion 423*b* is positioned at an outer side of the button frame unit 423 and coupled with the driving unit to drive the horizontal movement of the button frame unit 423.

The button unit 421 further includes a residual ice (or water) receiving unit 421*a* that is depressed from an upper surface of the button unit 421 toward a lower surface of the button unit 421 and that is separably movable. The button unit 421 includes a button body 421*c* to which the residual ice receiving unit 421*a* is detachably mounted.

Accordingly, if the residual ice receiving unit 421*a* is filled with much residual ice (or water), the user may release the residual ice receiving unit 421*a* to remove the internal residual ice (or water).

In some examples, a container contact unit 421*d* may be provided as an elastic member on the front surface of the residual ice receiving unit 421*a*, namely, on the face where the container for receiving ice, water, or the like contacts in order to reduce the amount of impact transferred to the container by the restoring force applied to the button unit 421 when the button unit 421 is pressed.

The dispensing button unit 420 further includes a residual ice guide unit 427 that is positioned at the upper side of the dispensing button unit 420 and guides ice or the like which is abnormally dispensed from the guide unit to the residual ice receiving unit 421*a*.

For example, the residual ice guide unit 427 includes an opening 427*a* to allow ice to be transferred at an inner side thereof and a slope portion 427*b* configured to be downwardly sloped at the circumference of the opening 327*a* to guide ice dispensed to the opening 427*a*.

In some implementations, the opening 427*a* of the residual ice guide unit 427 is fixed at a certain position of an upper portion of the dispensing button unit 420 such that it corresponds to the residual ice receiving unit 421*a* when the button unit 421 is pressed.

Also, the button unit 421 may have a maximum pressed position that is determined by a button movement restricting unit 428 positioned to face the rear surface of the button unit 421 according to the movement of the button frame unit 423.

Accordingly, upon pressing (or pushing) the button unit 421 to dispense ice, water, or the like, the user can realize that the button unit 421 has been pressed to its maximum position (by virtue of the container contact unit 421*d*).

Ice or the like dispensed through the guide unit as the button unit 421 is pressed may be received in the container, and in this case, if the maximum pressed position of the button unit 421 is not restricted, the ice or the like may not be received in the container and may spill.

Thus, the button movement restricting unit 428 may allow a stable dispensing operation that reduces such problem.

The button movement restricting unit 428 includes a hinge portion 429 coupled in a horizontal direction at a lower portion of the dispensing button unit 420, first and second extending portions 428*a* and 428*b* that extend to the front or rear sides of the dispensing button unit 420 upwardly with respect to a horizontal surface from the hinge portion 429, and a third extending portion 428*c* that is angled from an end of the second extending portion 428*b* and positioned to face the rear surface of the button unit 421 at the dispensing position.

An installation recess 425*c*, in which the button movement restricting unit 428 is installed, is provided at the frame movement guide unit 425 in a corresponding manner, and a coupling hinge unit 425*b* may be horizontally provided in the installation recess 425*c*.

When the button frame unit 423 is extended from a front surface of the dispenser receiving unit 401 by the driving unit, a protrusion 423*d* positioned on a lower surface of the button frame unit 423 pushes the first extending portion 428*a*. As the first extending portion 428*a* is pushed, the button movement restricting unit 428 is rotated based on the hinge portion 429. When the extending operation of the button frame unit 423 is completed, the third extending portion 428*c* is positioned such that it corresponds to the rear surface of the button unit 421.

Because the first extending portion 428*a* is in contact with and pressed by the protrusion 423*d* positioned on the lower surface of the button frame unit 423, the button movement restricting unit 428 is restricted in its counterclockwise rotation based on the depiction in FIG. 15.

As shown in FIG. 15, the rear surface of the button unit 421 is caught by the third extending portion 428*c* and, thereby, the third extending portion 428*c* restricts movement of the button unit 421 further into the dispenser receiving part 401 (e.g., defines a maximum pressed position).

Next, when the button frame unit 423 is received into the inner side of the dispenser receiving unit 401 by the driving unit, if the first extending portion 428*a* is released from a restrained state by the button frame unit 423, the second and third extending portions 428*b* and 428*c*, to which a relatively large load is applied compared with the first extending portion 428*a*, rotate downward. Namely, the button movement restricting unit 428 is rotated clockwise based on the depiction in FIG. 14.

Accordingly, the button frame unit 423 and the button unit 421 may be received into the dispenser receiving unit 401 without being interfered with by the button movement restricting unit 428.

Figure 16:
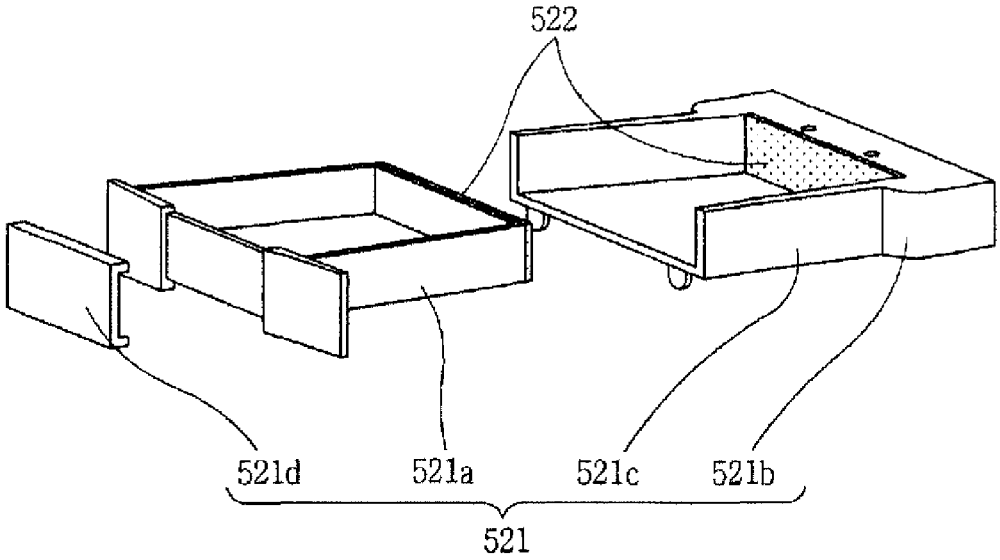
FIG. 16 is an exploded perspective view of a button unit.
Figure 17:
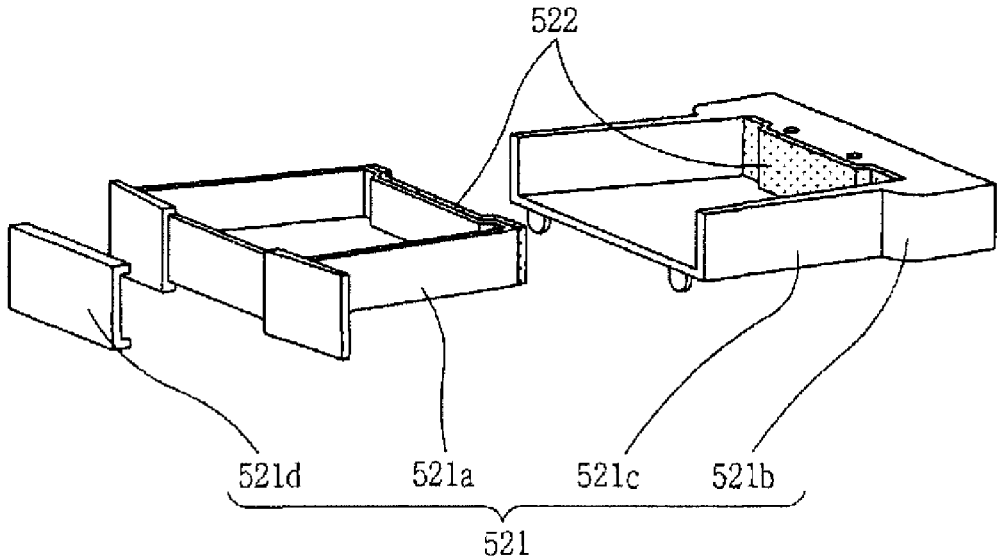
FIG. 17 shows an example of a tight attach unit.

FIG. 16 illustrates a button unit, and FIG. 17 shows an example of tight attach portions.

With reference to FIG. 16, in a refrigerator, a dispenser may have the same structure as the dispenser 100, except that the dispenser includes a button unit 521.

In some implementations, the button unit 521 includes a residual ice (or water) receiving unit 521*a* that is depressed from an upper surface of the button unit 521 toward a lower surface thereof and separably movable. The button unit 521 includes a button body 521*c* to which the residual ice receiving unit 521*a* is detachably mounted.

Accordingly, if the residual ice receiving unit 521*a* is filled with much residual ice (or water), the user may release the residual ice receiving unit 521*a* to remove the internal residual ice (or water).

The button unit 521 may include a stop end 521*b* that is positioned at a rear end of the side of the button unit 521 and that corresponds to a button unit stop recess to limit movement of the button unit 521 to a front side of a dispenser receiving part.

In some examples, a container contact unit 521*d* may be provided as an elastic member on the front surface of the residual ice receiving unit 521*a*, namely, on the face where the container for receiving ice, water, or the like contacts in order to reduce the amount of impact transferred to the container.

In addition, in some implementations, tight attach portions 522 are provided on a rear surface of the residual ice receiving unit 521*a* and on an inner surface of the button body 521*c* that contacts with the rear surface of the residual ice receiving unit 521*a*.

The tight attach portions 522 may be made of a magnetic material such as a magnet so that attraction occurs when the residual ice receiving unit 521*a* approaches the button body 521*c*.

As shown in FIG. 17, the tight attach portions 522 may have matching surfaces that fit together. Namely, one of the contacting surfaces of the residual ice receiving unit 521*a* and the button body 521*c* may be protruded and the other may be depressed in a corresponding manner.

With such structure, even if the button body 521*c*, which guides the residual ice guide unit 521*a*, does not have both sides when the residual ice receiving unit 521*a* is mounted in the button body 521*c*, the contacting surfaces of the residual ice receiving unit 521*a* and the button body 521*c* may be matched to allow the residual ice guide unit 521*a* to be stably mounted.

Figure 18:
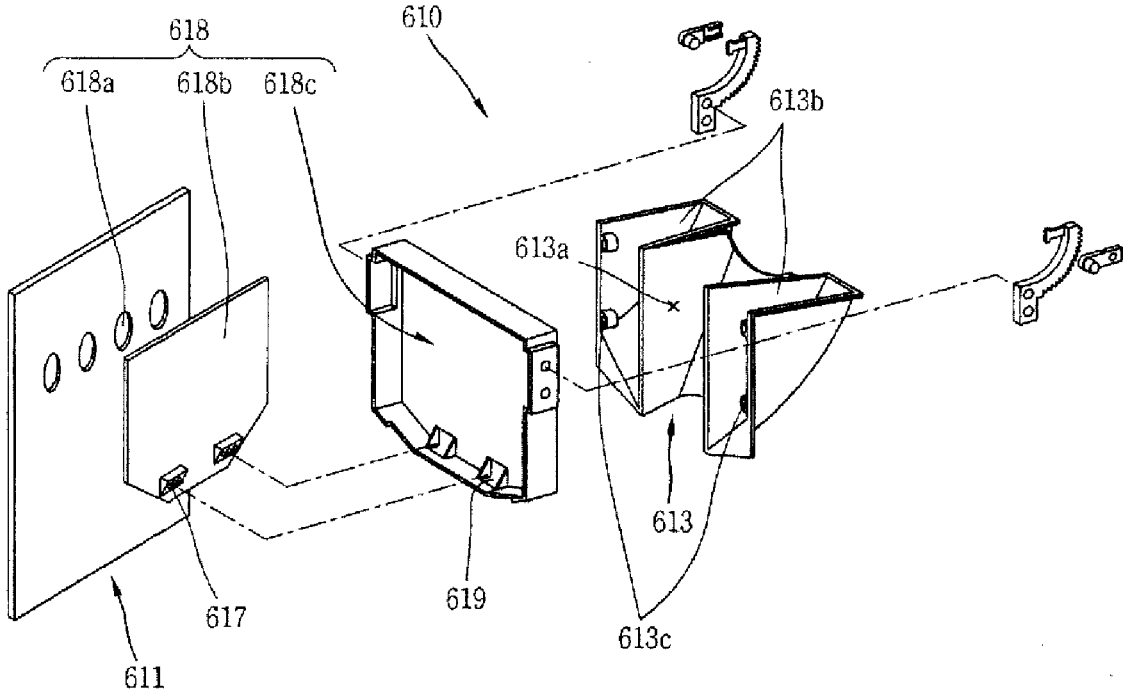
FIG. 18 is an exploded perspective view of a dispensing unit.
Figure 19:
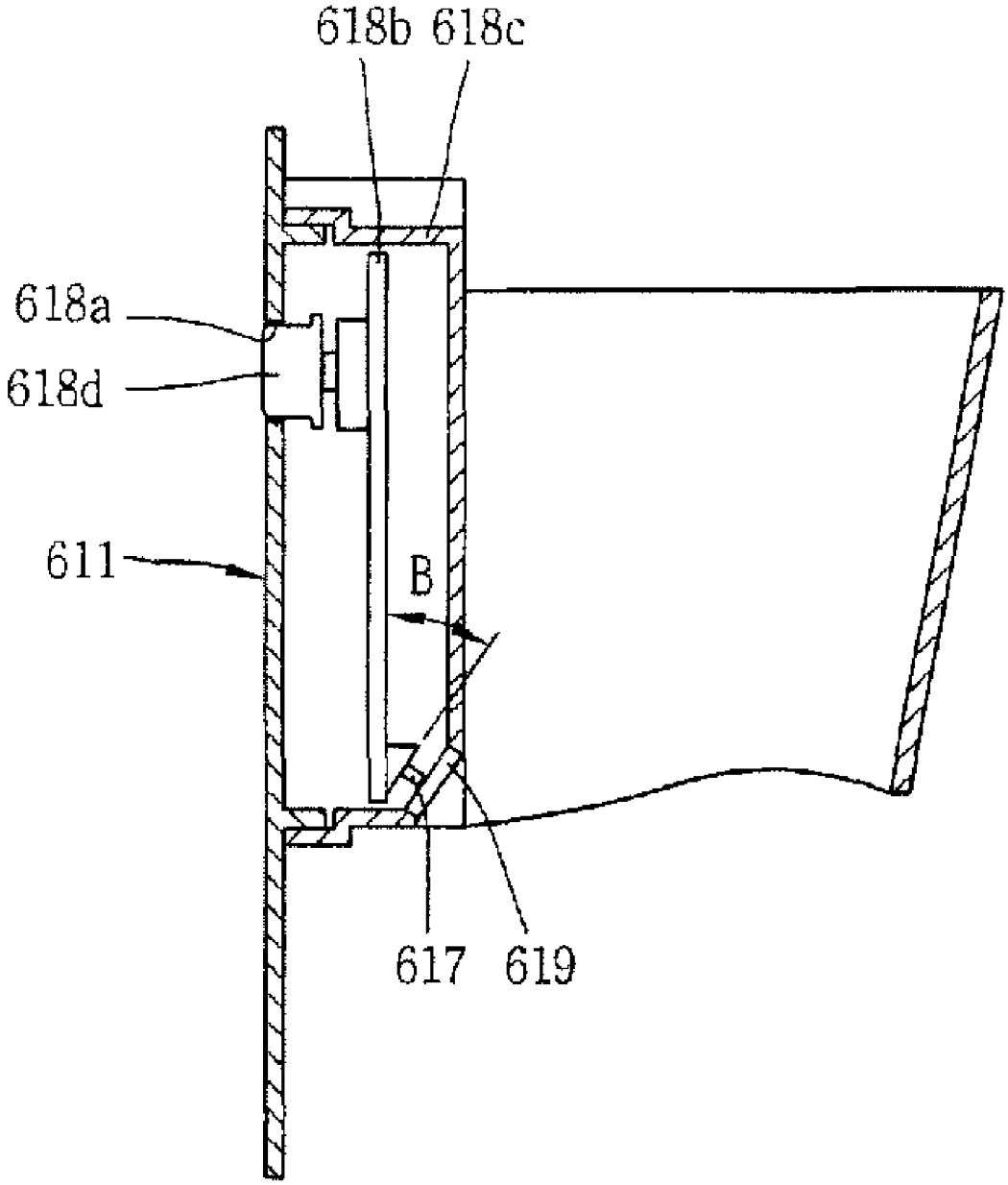
FIG. 19 is a sectional view of a dispensing unit.

FIGS. 18 and 19 illustrate a dispensing unit. In the following description, any structure and detailed description that would overlap with those already described above may be similar to the structure described above.

With reference to FIGS. 18 and 19, in a refrigerator, a dispenser may have the same structure as the dispenser 100, except that the dispenser may include a dispensing unit 610.

The dispensing unit 610 may include a control button unit 618 that controls the operation of the dispenser. The control button unit 618 includes a button PCB (Printed Circuit Board) 618*b* that generates a control signal when pressed by the user, a button receiving unit 618*a* positioned on the cover unit 611 and configured to transfer a pressing force to the button PCB 618*b*, and a PCB receiving unit 618*c* in which the button PCB 618*b* is received and fixed.

The PCB receiving unit 618*c* may be attached to a rear surface of the cover unit 611 and the guide unit 613 may be attached to a rear surface of the PCB receiving unit 618*c*.

The guide unit 613 includes a guide 613*a* that defines a single movement path when attached to the rear surface of the PCB receiving unit 618 to guide dispensed ice or the like and guide fixing units 613*b* provided at both sides of the guide 613*a* and having fastening units 613*c* configured to attach to the control button unit 618.

In some implementations, in the dispensing unit 610, the button PCB 618*b* includes a lighting unit 617 that illuminates a container receiving dispensed ice, water, or the like therein, and the PCB receiving unit 618*c* includes a lighting hole 619 through which light emitted from the lighting unit 617 passes.

The lighting unit 617 may be any of a plurality of lighting devices. For example, a light device having low power consumption such as an LED (Light Emitting Diode) may be provided.

In addition, because the lighting unit 617 emits light to the container positioned below the rear surface of the PCB receiving unit 618*c*, it may be provided to the lower surface of the button PCB 618*b* in terms of structure, and in this example, the lighting unit 617 may be provided at a certain angle (β) with the button PCB 618*b* so that light emitted from the lighting unit 617 may be directed to the lower side of the rear surface of the PCB receiving unit 618*c*.

The light hole 619 is positioned at a lower side of the rear surface of the PCB receiving unit 118*c*, and, in some examples, it is perpendicular to the direction of light emission in order not to interfere with light emitted from the lighting unit 617.

Figure 20:
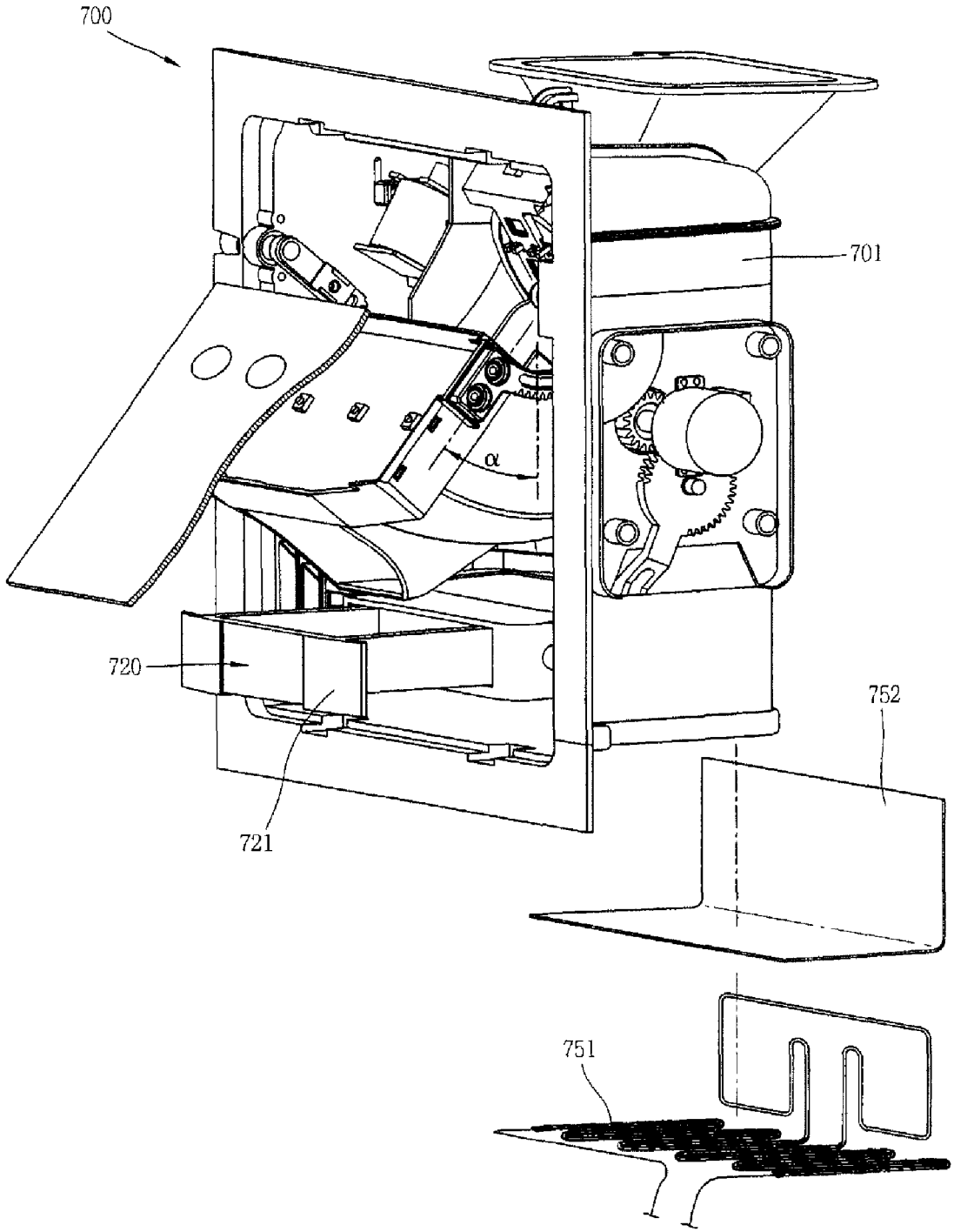
FIG. 20 is a perspective view of a dispenser in a refrigerator.

FIG. 20 illustrates a dispenser in a refrigerator. In the following description, any structure and detailed description that would overlap with those already described above may be similar to the structure described above.

With reference to FIG. 20, in a refrigerator, a dispenser 700 may have the same structure as the dispenser 100, except that the dispenser 700 includes a heating member 752 for evaporating water received in a residual ice receiving unit 721 and a conduction member 751.

The heating member 752 is provided near a dispensing button unit having the residual ice receiving unit 721, and increases temperature around the residual ice receiving unit 721 according to a convection process to facilitate evaporation of water existing in the residual ice receiving unit 721.

For this, the heating member 752 may be fixed on a rear surface or a bottom surface of a dispenser receiving unit 701.

Here, a fixing position of the heating member 752 may be an inner surface or an outer surface of the dispenser receiving unit 701.

The heating member 752 may be a hot wire that is bent to attach tightly to the wall surface of the dispenser receiving unit 701.

An insertion recess (not shown) may be defined in the wall surface of the dispenser receiving unit 701 in order to allow the heating member 752 to be inserted therein.

The conduction member 751 is provided to contact with the heating member 752 to effectively transfer heat generated from the heating member 752 to the dispensing button unit 720.

Thus, the conduction member 751 may be provided only on the surface facing the dispensing button unit 720.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator having a dispenser, comprising:

a cooling compartment;

a door configured to open and close at least a portion of the cooling compartment;

a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment;

a dispensing button unit that is configured to move, in a plane perpendicular to the surface of the door, between a stored position at which the dispensing button unit is positioned on the side of the surface of the door where the cooling compartment is positioned and an extended position at which at least a portion of the dispensing button unit is positioned on the side of the surface of the door opposite of the cooling compartment, the dispensing button unit being configured to, in the extended position, control dispensing of content through the dispenser outlet in response to application of force to the dispensing button unit; and a driving unit that is configured to move the dispensing unit from the received position to the dispensing position in response to user input and that is configured to move, in the plane perpendicular to the surface of the door and simultaneously with moving the dispensing unit, the dispensing button unit from the stored position to the extended position in response to the user input, wherein the dispensing button unit comprises:

a button frame unit that is positioned below the dispensing unit when the refrigerator is oriented in a normal operating orientation and that is configured to move, in the plane perpendicular to the surface of the door, between the stored position at which the button frame unit is positioned on the side of the surface of the door where the cooling compartment is positioned and the extended position at which at least a portion of the button frame unit is positioned on the side of the surface of the door opposite of the cooling compartment; and a button unit that is elastically supported by the button frame unit and that is configured to, when the button frame unit is oriented in the extended position, move, in response to application of force to the button unit, toward the surface of the door from a first position to a second position that is closer to the surface of the door than the first position and move, in response to release of the force applied to the button unit, away from the surface of the door from the second position to the first position.

2. The refrigerator of claim 1, wherein a hinge connects a portion of the dispensing unit with the door, the dispensing unit is configured to rotate, about an axis defined based on the hinge, between the received position and the dispensing position, and the driving unit is configured to rotate the dispensing unit from the received position to the dispensing position.

3. The refrigerator of claim 1, wherein the dispensing unit comprises:

a cover unit that is positioned in a plane of the surface of the door when the dispensing unit is oriented in the received position and that is configured to cover a space in the door in which the dispensing unit is received when the dispensing unit is oriented in the received position; and a guide unit that is attached to a surface of the cover unit positioned closest to the cooling compartment, that defines the dispenser outlet, and that is configured to guide ice through the dispenser outlet when the dispensing unit is oriented in the dispensing position.

4. The refrigerator of claim 1, wherein the button unit includes a residual ice receiving unit and is configured to receive and store, in the residual ice receiving unit, ice discharged from the dispenser outlet after a container used in actuating the button unit is moved from beneath the dispenser outlet.

5. The refrigerator of claim 1, wherein the refrigerator further comprises a button movement restricting unit that defines a maximum pressed position of the button unit and that is configured to restrict movement of the button unit toward the cooling compartment after the button unit has been pressed to the maximum pressed position.

6. The refrigerator of claim 5, wherein the button movement restricting unit comprises:

a hinge portion that, when the refrigerator is oriented in a normal operating orientation, defines an axis that is perpendicular to a direction of movement of the button unit and that is located below the button unit;

first and second extending portions that, when the refrigerator is oriented in the normal operating orientation, extend upward with respect to the hinge portion toward the button unit; and a third extending portion that extends at an angle from an end of the second extending portion and that is positioned to contact a surface of the button unit when the button unit has been pressed to the maximum pressed position.

7. The refrigerator of claim 6, wherein the end of the first extending portion contacts a lower surface of the button frame unit at the extended position and contacts a lower surface of the button unit at the stored position.

8. The refrigerator of claim 6, wherein the third extending portion is positioned below the button frame unit when the button frame unit is oriented in the stored position and the refrigerator is oriented in the normal operating orientation.

9. The refrigerator of claim 6, wherein, when the button frame unit moves from the stored position to the extended position, the button frame unit contacts the first extending portion and thereby rotates, about the axis defined by the hinge portion, the first extending portion downward from the button frame unit, which causes the second extending portion to rotate upward toward the button frame unit.

10. The refrigerator of claim 1, wherein:

the button unit includes a residual ice receiving unit and is configured to receive and store, in the residual ice receiving unit, ice discharged from the dispenser outlet after a container used in actuating the button unit is moved from beneath the dispenser outlet; and the button unit comprises a button body to which the residual ice receiving unit is detachably connected.

11. The refrigerator of claim 1, wherein, when the dispensing unit is oriented in the received position and the dispensing button unit is oriented in the stored position, the dispenser outlet of the dispensing unit and the dispensing button unit are positioned in a receiving space defined within the door and received in a dispenser receiving unit that defines, in the surface of the door, an opening through which the dispenser outlet of the dispensing unit moves when the dispensing unit moves from the dispensing position to the received position and through which the dispensing button unit moves when the dispensing button unit moves from the extended position to the stored position.

12. The refrigerator of claim 11, wherein the opening defined by the dispenser receiving unit is covered by the dispensing unit when the dispensing unit is oriented in the received position.

13. A refrigerator having a dispenser, comprising:

a cooling compartment;

a door configured to open and close at least a portion of the cooling compartment;

a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment;

a dispensing button unit that is configured to move, in a plane perpendicular to the surface of the door, between a stored position at which the dispensing button unit is positioned on the side of the surface of the door where the cooling compartment is positioned and an extended position at which at least a portion of the dispensing button unit is positioned on the side of the surface of the door opposite of the cooling compartment, the dispensing button unit being configured to, in the extended position, control dispensing of content through the dispenser outlet in response to application of force to the dispensing button unit; and a driving unit that is configured to move the dispensing unit from the received position to the dispensing position in response to user input and that is configured to move, in the plane perpendicular to the surface of the door and simultaneously with moving the dispensing unit, the dispensing button unit from the stored position to the extended position in response to the user input, wherein the driving unit comprises:

a driving gear configured to be driven by a motor;

a first following gear engaged with the driving gear and configured to rotate the dispensing unit from the received position to the dispensing position in response to the driving gear being driven by the motor; and a second following gear engaged with the driving gear and configured to move the dispensing button unit from the stored position to the extended position in response to the driving gear being driven by the motor.

14. The refrigerator of claim 13, wherein the driving gear, the first following gear, and the second following gear are configured to rotate in a plane that is perpendicular to a cover unit of the dispensing unit when the dispensing unit is oriented in the received position, the cover unit being positioned in a plane of the surface of the door and configured to cover a space in the door in which the dispensing unit is received when the dispensing unit is oriented in the received position.

15. The refrigerator of claim 13, wherein the diameter of the first following gear is smaller than the diameter of the second following gear.

16. The refrigerator of claim 13, wherein the diameter of the driving gear is smaller than the diameter of the first following gear and the diameter of the second following gear.

17. The refrigerator of claim 13, wherein the first following gear has a circular arc shape with a central angle of less than 360 degrees being defined between radial axes extending from a rotation axis of the arc and endpoints of the first following gear periphery, a first end of the first following gear is connected at the rotation axis, a second end of the first following gear is connected with the dispensing unit, and the first following gear is configured to rotate about the rotation axis in response to the driving gear being driven by the motor.

18. The refrigerator of claim 13, wherein the second following gear comprises:

a sliding unit that extends in a radial direction and comprises a sliding slot configured to receive a sliding protrusion positioned at a side of the dispensing button unit is received, the sliding unit being configured to move the dispensing button unit by applying force to the sliding protrusion when the sliding protrusion is received in the sliding slot.

19. A refrigerator, comprising:

a cooling compartment;

a door configured to open and close at least a portion of the cooling compartment;

a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment;

a dispensing button unit that is configured to move, in a plane perpendicular to the surface of the door, between a stored position at which the dispensing button unit is positioned on the side of the surface of the door where the cooling compartment is positioned and an extended position at which at least a portion of the dispensing button unit is positioned on the side of the surface of the door opposite of the cooling compartment, the dispensing button unit being configured to, in the extended position, control dispensing of content through the dispenser outlet in response to application of force to the dispensing button unit; and means for moving the dispensing unit from the received position to the dispensing position in response to user input and for moving, in the plane perpendicular to the surface of the door and simultaneously with moving the dispensing unit, the dispensing button unit from the stored position to the extended position in response to the user input, wherein the dispensing button unit comprises:

a button frame unit that is positioned below the dispensing unit when the refrigerator is oriented in a normal operating orientation and that is configured to move, in the plane perpendicular to the surface of the door, between the stored position at which the button frame unit is positioned on the side of the surface of the door where the cooling compartment is positioned and the extended position at which at least a portion of the button frame unit is positioned on the side of the surface of the door opposite of the cooling compartment; and a button unit that is elastically supported by the button frame unit and that is configured to, when the button frame unit is oriented in the extended position, move, in response to application of force to the button unit, toward the surface of the door from a first position to a second position that is closer to the surface of the door than the first position and move, in response to release of the force applied to the button unit, away from the surface of the door from the second position to the first position.

* * * * *